US007928969B2

(12) United States Patent
Ebisawa et al.

(10) Patent No.: US 7,928,969 B2
(45) Date of Patent: Apr. 19, 2011

(54) IMAGE DISPLAY APPARATUS

(75) Inventors: Hisafumi Ebisawa, Hiratsuka (JP); Akihiko Yamano, Sagamihara (JP); Hideaki Yui, Machida (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 788 days.

(21) Appl. No.: 11/961,756

(22) Filed: Dec. 20, 2007

(65) Prior Publication Data

US 2008/0150842 A1 Jun. 26, 2008

(30) Foreign Application Priority Data

Dec. 25, 2006 (JP) ..... 2006-347332

(51) Int. Cl.
*G06G 5/00* (2006.01)
*G09F 3/038* (2006.01)

(52) U.S. Cl. ..... 345/204; 345/690

(58) Field of Classification Search ..... 345/204, 345/690

See application file for complete search history.

(56) References Cited

U.S. PATENT DOCUMENTS

| | | | | |
|---|---|---|---|---|
| 6,307,327 | B1 | 10/2001 | Xie et al. | 315/169.4 |
| 6,604,972 | B1 | 8/2003 | Yamano | 445/24 |
| 6,677,706 | B1 | 1/2004 | Hara et al. | 313/496 |
| 6,760,001 | B2 | 7/2004 | Kanda et al. | 345/74.1 |
| 6,822,397 | B2 | 11/2004 | Kawasaki et al. | 315/169.2 |
| 6,888,519 | B2 | 5/2005 | Yamano et al. | 345/75.2 |
| 7,298,094 | B2 | 11/2007 | Yui | 315/161 |
| 7,304,640 | B2 | 12/2007 | Yamashita et al. | 345/207 |
| 2004/0239698 | A1* | 12/2004 | Kamada et al. | 345/714 |
| 2005/0148272 | A1 | 7/2005 | Yamano et al. | 445/63 |
| 2005/0206958 | A1 | 9/2005 | Inamura | 358/3.23 |
| 2005/0276096 | A1 | 12/2005 | Hara et al. | 365/158 |
| 2006/0132396 | A1 | 6/2006 | Yui | 345/75.2 |
| 2006/0132401 | A1* | 6/2006 | Yamazaki et al. | 345/81 |
| 2007/0241656 | A1 | 10/2007 | Hara et al. | 313/483 |

FOREIGN PATENT DOCUMENTS

| | | |
|---|---|---|
| JP | 2000-75833 | 3/2000 |
| JP | 2005-301218 | 10/2005 |
| JP | 2006-195444 | 7/2006 |

* cited by examiner

*Primary Examiner* — Amare Mengistu
*Assistant Examiner* — Insa Sadio
(74) *Attorney, Agent, or Firm* — Fitzpatrick, Cella, Harper & Scinto

(57) ABSTRACT

There is provided an image display apparatus having: display devices; a spacer; and a drive circuit. The drive circuit has a first correction circuit that corrects inputted data to make it linear with luminance and a second correction circuit. The second correction circuit has a calculation circuit for calculating an evaluation value and an adjustment circuit. The evaluation value relates to suppression effect that the spacer suppresses an influence on the light emission of a predetermined emitting region due to the inputted image data by driving non-corresponding display devices and is calculated by using the electric charge signal after converting a luminance signal into an electric charge signal. The adjustment circuit calculates an adjustment value that refers to a property of a phosphor based on the luminance signal and dynamically calculates the correction value by using the evaluation value and the adjustment value.

12 Claims, 16 Drawing Sheets

IMAGE DISPLAY APPARATUS

BACKGROUND OF THE INVENTION

1. Field of the Invention

The present invention relates to an image display apparatus.

2. Description of the Related Art

Japanese Patent Application Laid-Open No. 2000-75833 discloses a phosphor saturation correction method as gamma correction for faithfully displaying a color and contrasting of an original image signal about a luminance signal and a color signal in consideration of a γ property of a phosphor in a display.

The U.S. Pat. No. 6,307,327 discloses a pixel data correction method for controlling a visibility of a spacer by a field emission display. According to this pixel data correction method, defining a first region in the vicinity of a spacer and a second region not in the vicinity of the spacer, then, in order to prevent a viewer from seeing display unevenness caused by the spacer, pixel data to be transmitted to the first region is corrected in response to an intensity level of a light to be generated by a plurality of pixels in the first region in the vicinity of the spacer.

Japanese Patent Application Laid-Open No. 2005-301218 discloses the fact that a correction amount is a value reflecting a driving state of phosphors that are located around a phosphor to be corrected and a value such that adjustment in accordance with a no-linearity property between an input signal and the display of the phosphor is made based on a value of an input signal corresponding to the correction target phosphor.

Japanese Patent Application Laid-Open No. 2006-195444 discloses that the correction amount is changed for each of R, G, and B phosphors when carrying out correction in order to prevent the viewer from seeing the display unevenness caused by the spacer and the optimum correction amount is changed depending on the state of lighting.

An image display apparatus that can realize a more preferable image display is desired. In this case, the more preferable image display is image display having small image unevenness, for example.

At first, a beam and a halation will be described. When an electron emitted from an electron source collides with the phosphor, a beam is generated. Here in this specification, a beam means light generated by irradiation of electron emitted from an electron-emitting device corresponding to a phosphor. At the same time, the electron emitted by an electron-emitting device not only generates the beam but it also scatters elastically (FIG. 15). Then, backward scattered electron that is scattered around due to the elastic scattering flashes a surround phosphor. This light emission due to the backward scattered electron is referred to as halation. Further, a beam luminance indicates a luminance only due to beam lighting in the phosphor and the beam luminance does not include the light emission due to the backward scattered electron (FIG. 15).

The inventors of the present invention found that the increase amount of light emission generated when the same amount of the backward scattered electrons is added was different between the lighting phosphor and the no-lighting phosphor (FIG. 16). When the surround phosphors are lighted as shown in FIG. 16A, the amount of the backward scattered electrons is distributed almost uniformly in the target phosphor. However, comparing the halation light emission amount of the place where the beam is lighted with that of the place where the beam is not lighted in the same phosphor, it is determined that halation amount at the place where the beam is lighted is smaller than that at the place where the beam is not lighted (FIG. 16D). Thereby, it is also determined that the spacer unevenness is changed depending on the lighting state of the target phosphor and the optimum correction amount is also changed.

The inventors of the present invention found that a ratio between the luminance of the beam and the luminance of the halation was not always constant for the beam luminance but this ratio was changed depending on variation of the input value of a halation correction unit shown in FIG. 4 and FIG. 5 (FIG. 13). Checking a cause of this in detail, a relation between the luminance of the phosphor and the electric charge amount is represented by $\gamma \neq 1$ in a high electric charge region such as a lighting beam, however, it is represented by γ nearly equal 1 in a low electric charge region such as a halation (FIG. 14). Thereby, depending on a lighting state of pixels around the pixel to be corrected, a ratio of unevenness of the spacer or the like is changed. According to the conventional correction method, the above-described relation between the luminance of the phosphor and the electric charge amount is not considered.

SUMMARY OF THE INVENTION

An object of the present invention is to provide an image display apparatus that can correct unevenness of display with a high degree of accuracy.

In order to achieve the above-described object, the present invention provides an image display apparatus including: a plurality of pixels having an electron-emitting device and a light emitting region that emits light when an electron emitted from the electron-emitting device enters therein, respectively; a spacer for maintaining a space between the electron-emitting device and the light emitting region; a first conversion circuit for converting an image signal; a second conversion circuit for converting output of the first conversion circuit; a correction value calculation circuit for calculating a correction value on the basis of output of the second conversion circuit; a correction value adjustment circuit for adjusting the correction value on the basis of output of the first conversion circuit and outputting the adjusted correction value; and a correction value addition circuit for correcting output of the first conversion circuit by the adjusted correction value; wherein the first conversion circuit performs conversion such that a linearity between output of the first conversion circuit and a luminance to be displayed becomes higher than a linearity between the image signal and the luminance to be displayed; the second conversion circuit is a circuit such that a linearity between output of the second conversion circuit and the amount of electron to be emitted is higher than a linearity between output of the first conversion circuit and the amount of electron to be emitted; the spacer is located on a position where an electron directed from a light emitting region of a first pixel toward a light emitting region of a second pixel is blocked; the correction value calculation circuit calculates a correction value corresponding to the second pixel on the basis of the output corresponding to the first pixel in the output of the second conversion circuit; and the correction value is a value that can reduce a difference between a luminance of the second pixel and a luminance of a pixel that is located separately from the spacer further than the second pixel.

Here, "reducing a difference between a luminance of the second pixel and a luminance of a pixel that is located separately from the spacer further than the second pixel" means reducing a variance of luminance of these pixels generated when image signals having same value are inputted thereto.

In addition, the present invention provides an image display apparatus including: a plurality of pixels having an electron-emitting device and a light emitting region that emits light when an electron emitted from the electron-emitting device enters therein, respectively; a first conversion circuit for converting an image signal; a second conversion circuit for converting output of the first conversion circuit; a correction value calculation circuit for calculating a correction value on the basis of output of the second conversion circuit; a correction value adjustment circuit for adjusting the correction value on the basis of output of the first conversion circuit and outputting the adjusted correction value; and a correction value addition circuit for correcting output of the first conversion circuit by the adjusted correction value; wherein the first conversion circuit performs correction such that a linearity between output of the first conversion circuit and a luminance to be displayed becomes higher than a linearity between the image signal and the luminance to be displayed; the second conversion circuit performs correction such that a linearity between output of the second conversion circuit and the amount of electron to be emitted becomes higher than a linearity between output of the first conversion circuit and the amount of electron to be emitted; the plurality of pixels includes a first pixel and a second pixel located in the vicinity of the first pixel, and a distance between the first pixel and the second pixel is one that a reflection electron from the first pixel reaches the second pixel; the correction value calculation circuit calculates a correction value corresponding to the second pixel on the basis of the output corresponding to the first pixel in the output of the second conversion circuit; and the correction value is a value that can correct increase of the luminance of the second pixel due to the light emission of the second pixel generated by the reflection electron from the first pixel.

This correction suppresses the luminance unevenness and color unevenness generated when each image signal corresponding to each pixel have same value.

In addition, the present invention provides an image display apparatus including: a plurality of display devices having corresponding light emitting regions, respectively, and displaying an image by making the light emitting regions emit light; a spacer for preventing the light emission of the predetermined light emitting region caused by driving of a display device corresponding to the light emitting region other than a predetermined light emitting region; and a drive circuit for outputting a drive signal to drive the display device on the basis of the inputted image data; wherein the drive circuit has a first correction circuit for obtaining a luminance signal by correcting the inputted image data so as to be brought close to a signal that is linear with respect to the luminance, and a second correction circuit for outputting the corrected drive signal; the second correction circuit has an evaluation value calculation circuit for calculating an evaluation value that evaluates a suppression effect that the spacer suppresses an influence on the light emission of a predetermined light emitting region due to the inputted image data, the influence being caused by driving of the display device corresponding to the light emitting region other than the predetermined light emitting region, and an adjustment circuit; the evaluation value calculation circuit converts the luminance signal into an electric charge signal showing an electric charge amount that is necessary for obtaining a luminance that is designated by a luminance signal by correcting the luminance signal so as to be brought close to a signal that is linear with respect the electric charge amount and then, calculates the evaluation value that evaluates the suppression effect by using the electric charge signal; and the adjustment circuit calculates an adjustment value that refers to a property of a phosphor of the display device on the basis of the luminance signal and dynamically calculates a correction value corresponding to the drive signal using the evaluation value and the adjustment value.

In addition, the present invention provides an image display apparatus including: a plurality of light emitting regions having corresponding light emitting regions, respectively, and displaying an image by making the light emitting region emit light; a spacer for preventing the light emission of a predetermined light emitting region caused by driving of a display device corresponding to the light emitting region other than the predetermined light emitting region; and a drive circuit for outputting a drive signal to drive the display device on the basis of the inputted image data; wherein the drive circuit has a first correction circuit for obtaining an electric charge signal by correcting the inputted image data so as to be brought close to a signal that is linear with respect to the electric charge amount; and a second correction circuit for outputting the corrected drive signal; the second correction circuit has a calculation circuit for calculating an evaluation value that evaluates a suppression effect that the spacer suppresses an influence on the light emission of a predetermined light emitting region due to the inputted image data, the influence being caused by driving of the display device corresponding to the light emitting region other than the predetermined light emitting region, and an adjustment circuit; the calculation circuit calculates the evaluation value that evaluates the suppression effect by using the electric charge signal; and the adjustment circuit converts the electric charge signal into a luminance signal by correcting the electric charge signal so as to be brought close to a signal that is linear with respect to the luminance, calculates an adjustment value that refers to a property of a phosphor of the display device on the basis of the luminance signal, and dynamically calculates a correction value corresponding to the drive signal using the evaluation value and the adjustment value.

According to the present invention, the display unevenness can be corrected with a high degree of accuracy.

DETAILED DESCRIPTION OF THE INVENTION

Figure 1:
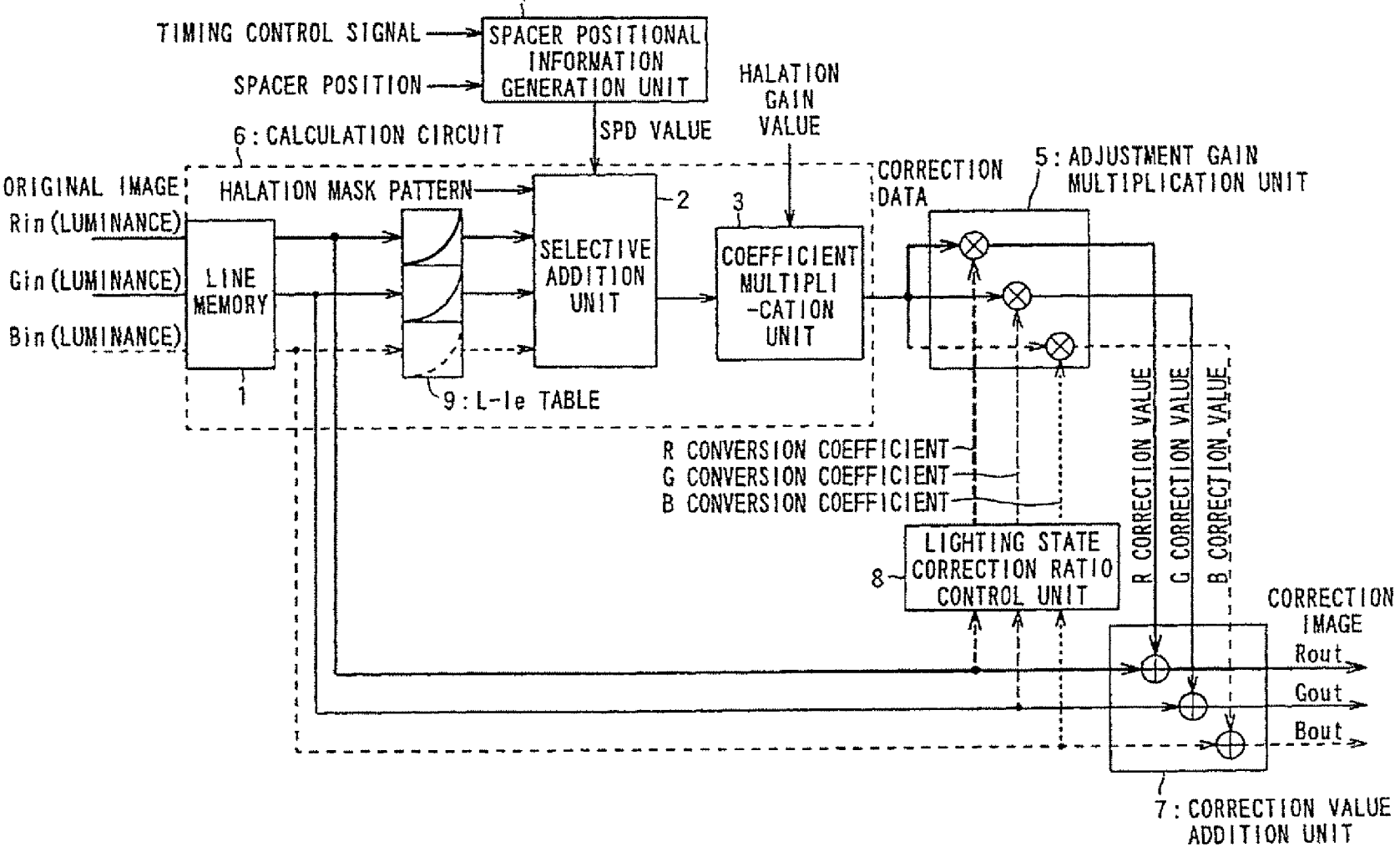
FIG. 1 is a view showing a correction circuit (a phosphor saturation correction is made after a halation correction) according to the present invention.
Figure 4:
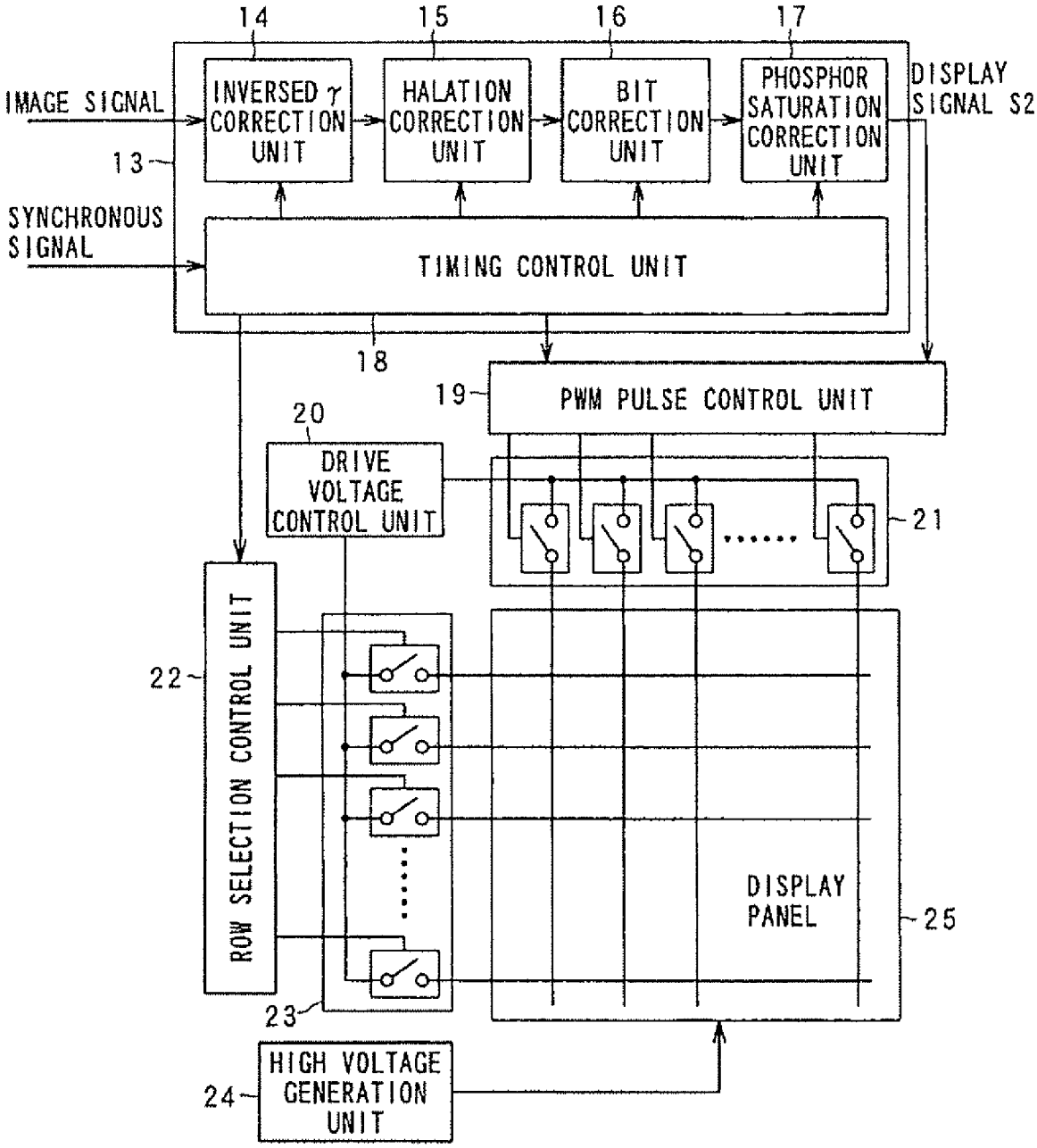
FIG. 4 is a configuration diagram of a drive circuit according to the present invention.

FIG. 1 is a halation correction circuit 15 according to the present embodiment (corresponding to "a second correction circuit" according to the present invention). FIG. 4 is a configuration diagram of a drive circuit according to the present invention. As shown in FIG. 4, the halation correction circuit 15 is arranged on a prestage of a phosphor saturation correction unit 17.

As shown in FIG. 1, the halation correction circuit 15 according to the present embodiment is configured by a calculation circuit 6, an adjustment gain multiplication unit 5, a lighting state correction ratio control unit 8, and a correction value addition unit 7. The calculation circuit 6 is configured by a line memory 1, an L-Ie table unit 9, a selective addition unit 2, and a coefficient multiplication unit 3. The adjustment gain multiplication unit 5 and the lighting state correction ratio control unit 8 correspond to the adjustment circuit or the correction value addition circuit of the present invention.

In the line memory 1, the original image data is inputted. Further, the original image data is a luminance signal (R, G, and B signals) obtained by correcting a signal so as to be brought close to a signal that is linear with respect to the luminance by means of an inversed γ correction unit 14. The line memory 1 outputs an input image signal of a peripheral reference pixel for the correction target pixel.

The L-Ie table unit 9 converts the inputted luminance signal to a signal showing an electric charge amount (referred to as an electric charge signal) necessary for obtaining the luminance that is designated by this luminance signal. The L-Ie table unit 9 converts the input image signal of the peripheral reference pixel to an electron charge signal by means of correcting this input image signal so as to be brought contact to a signal that is linear for the electric charge amount. In the selective addition unit 2, an electric charge signal and a SPD value are inputted, and then, the selective addition unit 2 outputs the lighting state of the correction reference pixel. The selective addition unit 2 can accurately evaluate the halation amount by using the electric charge signal. The SPD value will be described later.

In the coefficient multiplication unit 3, the lighting state of the correction reference pixel and the halation gain value are inputted, and this coefficient multiplication unit 3 calculates an evaluation value (correction data before being adjusted) that evaluates a suppression effect. The adjustment gain multiplication unit 5 multiplies the evaluation value with the R, G, and B conversion coefficients (they correspond to "the adjustment value" of the present invention) and dynamically calculates the correction value referring to a property of each of R, G, and B phosphors of the correction target pixel.

The peripheral reference pixels are pixels around the correction target pixel and the peripheral reference pixels mean pixels within a range where the backward scattered electrons are scattered.

The correction reference pixels mean pixels within a range where the backward scattered electrons therefrom to the correction target pixel are blocked by the spacer among the peripheral reference pixels. The spacer blocking will be described later.

The halation gain value is a coefficient for converting the addition result into the blocked halation amount.

Here, the halation will be described.

The halation is spread in a circle nearly evenly around the beam position. Light emission of a phosphor having color other than lighting color is caused. Therefore, the halation is a white (R, G, B) light emission so as to generate color mixture when an image signal such as a single color is transmitted.

In addition, when the backward scattered electrons are blocked by the spacer, this blocked amount does not contribute to the halation. As a result, in the vicinity of the spacer and not in the vicinity of the spacer, there is a difference in the light emission amount due to the halation. Particularly, when an image with a small spacious frequency is outputted, the halation may generate luminance unevenness and color unevenness (display unevenness) in the vicinity of the spacer.

Next, the halation correction will be described.

The halation correction is a correction method for calculating a spacer blocking amount of the halation and preventing unevenness from being remarkable by adding the light emission amount for blocking to the phosphor in the vicinity of the spacer that lacks the light emission amount.

The spacer blocking amount of the halation is assessed on the basis of the pixel (the correction reference pixel) on the opposite side of the spacer with respect to the position of the correction target pixel and also within the halation distribution range.

Since the halation distribution range is nearly fixed on the entire panel, if a distance between the correction target pixel and the spacer is found, the position and the number of the correction reference pixels can be assessed.

A spacer positional information generation unit 4 stores the position of the correction reference pixels for a correction target pixel in the vicinity of the spacer as the SPD value.

The line memory 1 collects the input image signals to the peripheral reference pixels. After performing the processing for converting the input image signal into another form (an electric charge signal) which can calculate the halation amount, the selective addition unit 2 adds the lighting states of the correction reference pixel due to the SPD value.

The conversion processing before adding (namely, the L-Ie table processing) is changed depending on an anteroposterior relation between the halation correction processing and the phosphor saturation correction processing. The details of this processing will be described later.

According to the processing at the selective addition unit 2, a lighting total value of the beam to generate a halation that is blocked by the spacer can be assessed. The coefficient multiplication unit 3 calculates the halation unevenness amount (the evaluation value) to be generated by the spacer blocking by multiplying the lighting total value with the halation gain value. By multiplying this evaluation value with the R, G, and B conversion coefficients, a correction value for the input signal of the correction target pixel is obtained.

<Adjustment Circuit>

In the lighting state correction ratio control unit 8, an input image signal of the correction target pixel (a luminance signal) is inputted. The lighting state correction ratio control unit 8 calculates the R, G, and B conversion coefficients on the basis of this input image signal. This conversion coefficient (corresponding to "the adjustment value" of the present invention) is a coefficient that converts the evaluation value of the output of the coefficient multiplication unit 3 shown in FIG. 1 and FIG. 2 into the optimum correction value in response to the kind of the phosphor of the correction target pixel.

The lighting state correction ratio control unit 8 has a function for adjusting the evaluation value into the correction value corresponding to the correction target pixel.

As a result of verification of the present inventor, it was found that the light emission amounts due to the electric charge are different in the lighting pixel and the no-lighting pixel even if the same amount of backward scattered electrons are added thereto (FIG. 16).

Therefore, when the image signal corresponding to the phosphor is varied, a light emission efficiency of the halation to be added to the image signal is measured and the luminance amount of the spacer unevenness for change of the input image signal is assessed. The light emission efficiency of the halation is a ratio between the backward scattered electron amount and the halation luminance lighted thereby. Hereinafter, a calculation method of the light emission efficiency will be described with reference to FIG. 16.

<Calculation Method of Light Emission Efficiency>

Figure 16A:
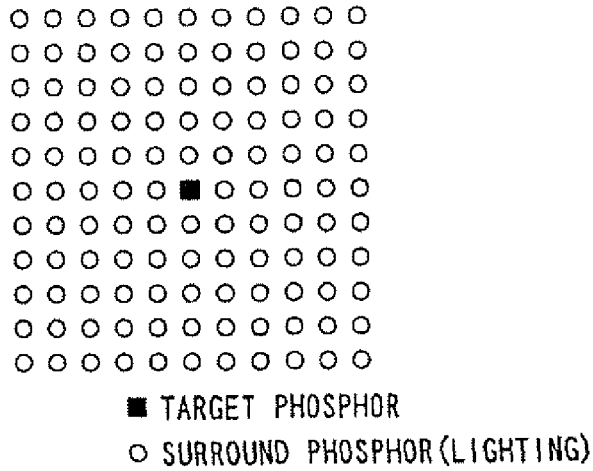
FIGS. 16A, 16B, 16C and 16D are views for explaining a measurement method of a ratio between a backward scattered electron and a halation, which is changed depending on a lighting state of a phosphor.
Figure 16B:
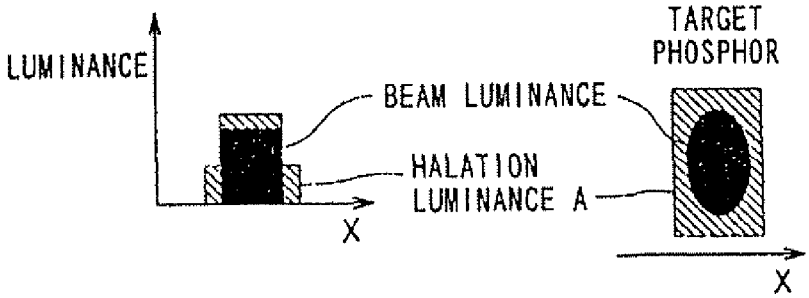
Figure 16C:
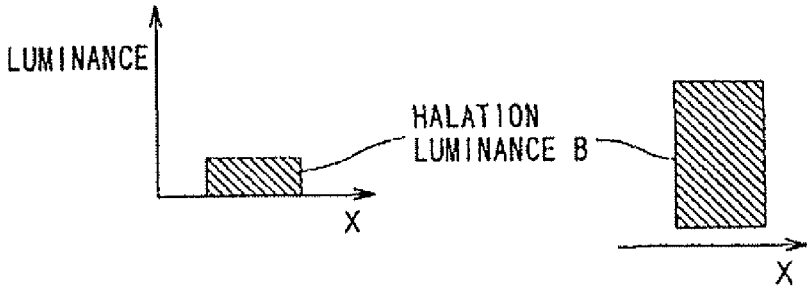
Figure 16D:
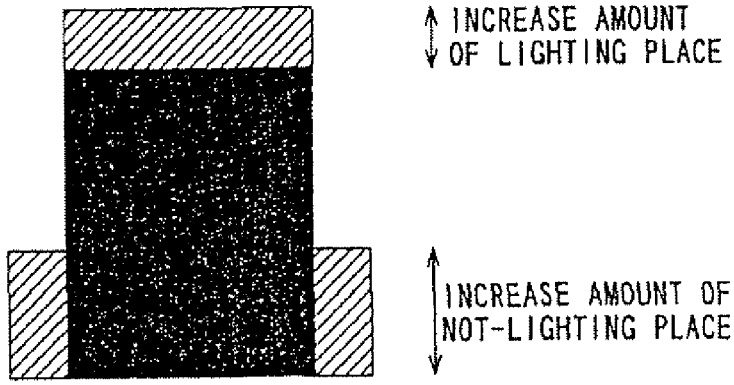

At first, one pixel of the target panel to be corrected is defined as a measurement target and its peripheral reference pixels are left as it is lighting (FIG. 16A). Then, increase of the halation due to lighting of the peripheral reference pixel is measured while changing the lighting state of the correction target pixel. Light emission efficiency is a ratio of a halation luminance A (FIG. 16B) when the correction target pixel is lighting to a halation luminance B (FIG. 16C) when the correction target pixel is not lighting. The halation luminance A can be obtained as follows. At first, a luminance a1 is measured with the peripheral reference pixels being not lighted and the correction target pixel being lighted. Next, a luminance a2 is measured with the peripheral reference pixels being lighted and the correction target pixel being lighted. The halation luminance A can be obtained by A=a2−a1. The halation luminance B can be obtained by measuring luminance of the correction target pixel with the peripheral reference pixels being lighted and the correction target pixel not being light. Then, the light emission efficiency can be obtained by A/B.

Figure 11:
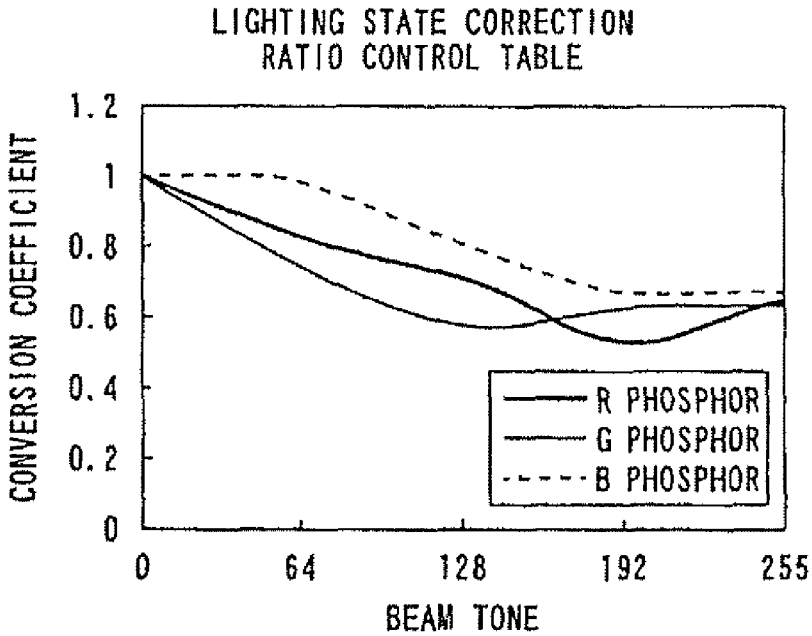
FIG. 11 is a view showing a conversion coefficient (for a table) (an input 8 bit) to be inputted in a lighting state correction ratio control unit.

A graph (a lighting state correction ratio control table) shown in FIG. 11 shows an example showing the light emission efficiency for each input tone of the correction target pixel. The change of this light emission efficiency (the property of the phosphor) represents a conversion coefficient (an adjustment value) to convert the evaluation value into the optimum correction value. By incorporating this conversion coefficient into the lighting state correction ratio control unit 8, it is possible to convert the evaluation value into the optimum correction amount.

Further, the halation electron from the peripheral reference pixel of a line to be driven prior to the correction target pixel is entered with the phosphor of the correction target pixel not being excited. In addition, the halation electron from the peripheral reference pixel of the line to be driven after the correction target pixel is entered with the phosphor of the correction target pixel being excited. As a result, it is preferable that the conversion coefficient (the adjustment value) is optimized in accordance with a relation between the spacer and the correction target pixel in a more precise sense.

<L-Ie Table Unit 9>

The L-Ie table unit 9 has a function to accurately calculate the unevenness amount from each lighting state of the correction target pixel and its peripheral reference pixels.

In the L-Ie table unit 9, the luminance signal indicating the lighting state of each pixel read by the line memory 1 is inputted, and this L-Ie table unit 9 converts the luminance signal into an electric charge signal representing an electric charge amount necessary for obtaining a luminance that is designated by the luminance signal by correcting the luminance signal so as to be brought close to a signal that is linear with respect to the electric charge. By using the electric charge signal, it is possible to accurately obtain the halation light emission amount to be generated from each phosphor.

In JP-A No. 2000-75833, it is described that the light emission property of the phosphor is not linear with respect to the amount of the electron beams to be irradiated and this light emission property is changed depending on the kind of the phosphor, a beam intensity of the electron beam irradiated on the phosphor, and a beam irradiation time or the like. Generally, in the light emission property of the phosphor, there is a phenomenon that, the longer the irradiation time of the beam is and the stronger the intensity of the beam is, its light emission luminance is lowered (this is referred to as a saturation of the phosphor). Due to the existence of this phenomenon, the L-Ie table unit 9 is provided. According to the same reason, an Ie-L table unit 11 is provided in a correction ratio control unit 10 shown in FIG. 2 (FIG. 3).

Figure 5:
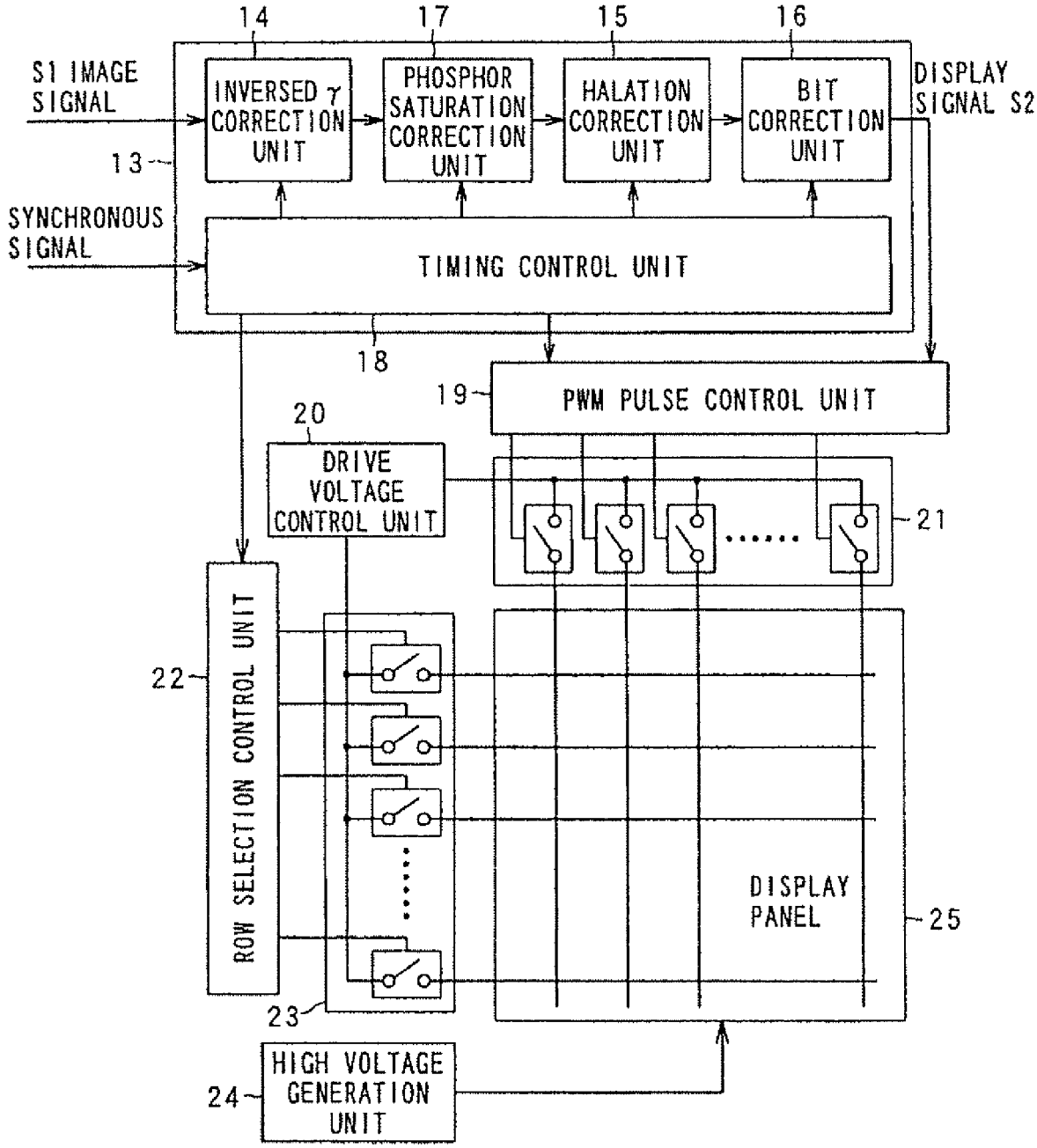
FIG. 5 is a configuration diagram of a drive circuit according to the present invention.

As shown in FIG. 4, in the case that the phosphor saturation correction unit 17 is located after the halation correction unit 15, the L-Ie table unit is installed as shown in FIG. 1. Further, as shown in FIG. 5, the phosphor saturation correction unit 17 is located prior to the halation correction unit 15, the Ie-L table unit is installed as shown in FIG. 3. In the case that the phosphor saturation correction unit 17 is located on the rear stage of the halation correction unit 15, a signal of an input original image is made into a luminance signal (FIG. 1). It is necessary to accurately obtain the luminance information of the halation from this luminance signal. Therefore, the luminance signal is converted into the electric charge signal of the beam (a luminance L→an electric charge Ie). The reason of this is that a relation between an electric charge amount of an electron (a beam electric charge amount) for emitting a beam and a halation is linear. Therefore, putting the L-Ie table before the selective addition unit 2, the luminance signal is converted into a form that can commute the halation for input (namely, the electric charge signal). Since the luminance signal and any of the evaluation value and the adjustment value that are obtained on the basis of the electric charge signal have not been given the phosphor saturation correction yet, the correction value may be only added to the luminance signal.

Next, how to obtain the present L-Ie table will be described.

Figure 6:
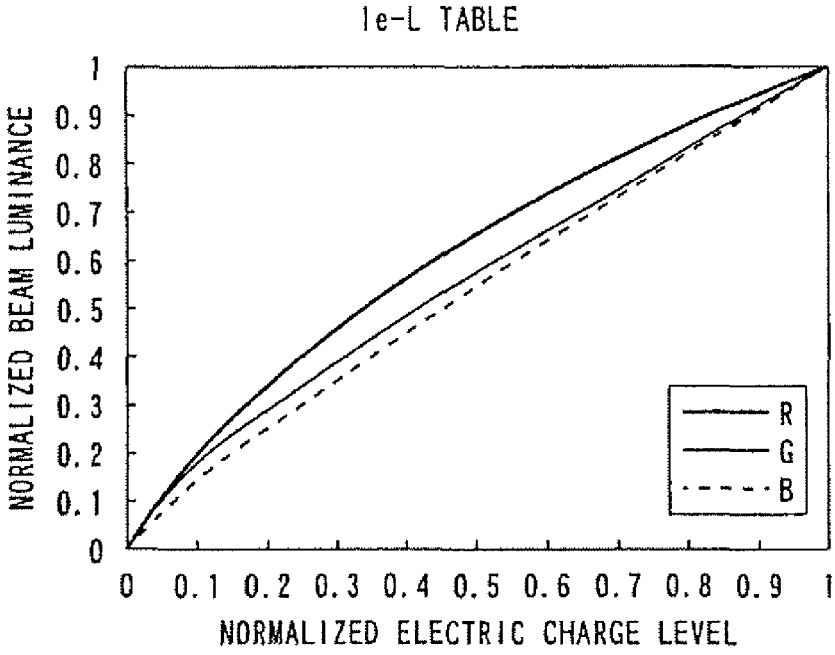
FIG. 6 is a view showing a Ie-L table unit data (input and output values are normalized)
Figure 8:
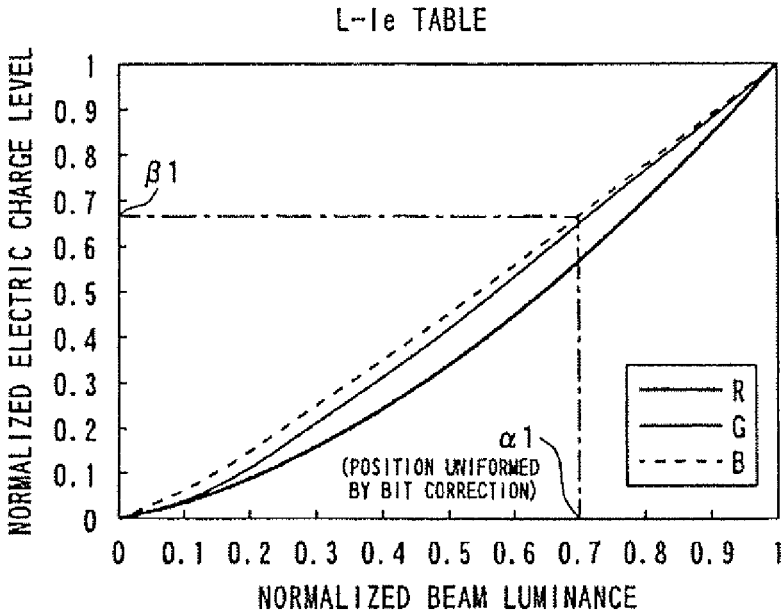
FIG. 8 is a view showing an L-Ie table unit data (input and output values are normalized)
Figure 9:
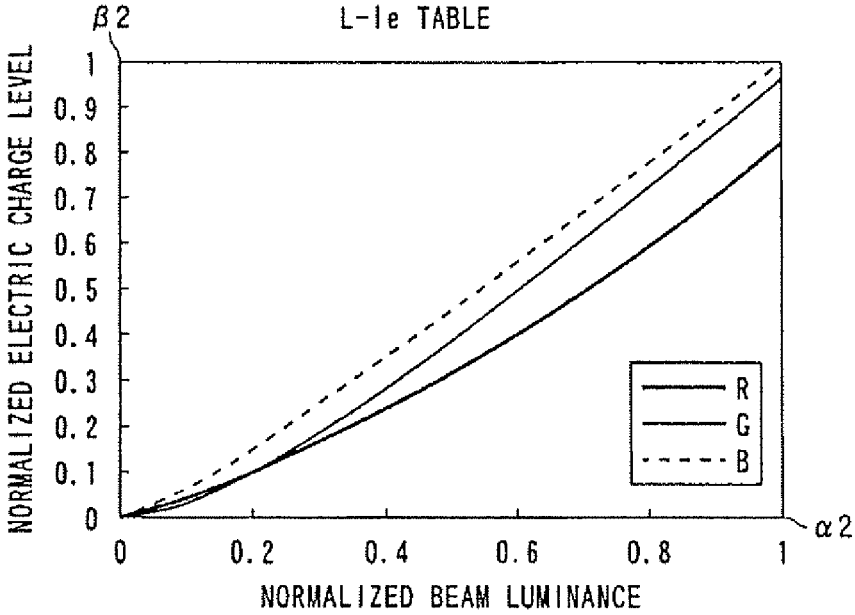
FIG. 9 is a view showing an L-Ie table unit data (input and output values are normalized) when a Bit correction is considered.

At first, the gamma properties of R, G, and B are measured, and input and output are normalized at each highest value (FIG. 6). Inverse-converting this (FIG. 8) and after that, the output is normalized at the highest output position to be decided by BIT correction and the highest value among R, G, and B outputs on its location (FIG. 9).

The BIT correction is the processing on the front stage of the phosphor saturation correction unit 17 of FIG. 4. When the processing has not been carried out yet, output from each phosphor of a panel is varied. The BIT correction is a method to uniform the highest output to a predetermined luminance value in order to prevent the variation.

Here, as an example, an example of the BIT correction for correcting the beam luminance into 0.7 times of the highest luminance is shown. $\alpha$1 and $\beta$1 in FIG. 8 correspond to $\alpha$2 and $\beta$2 in FIG. 9, respectively. This is an L-Ie table.

Figure 2:
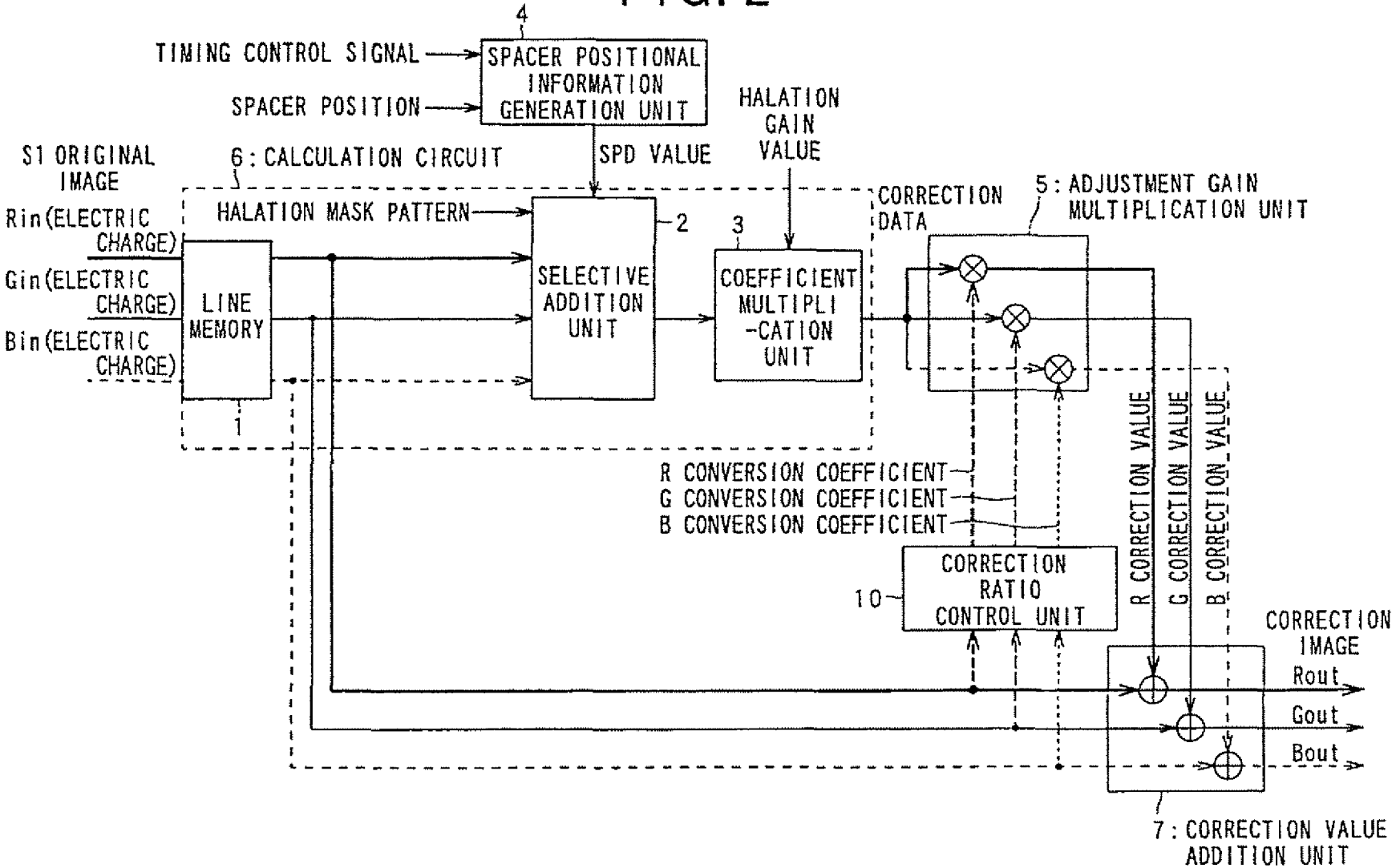
FIG. 2 is a view showing a correction circuit (a phosphor saturation correction is made before a halation correction) according to the present invention.
Figure 3:
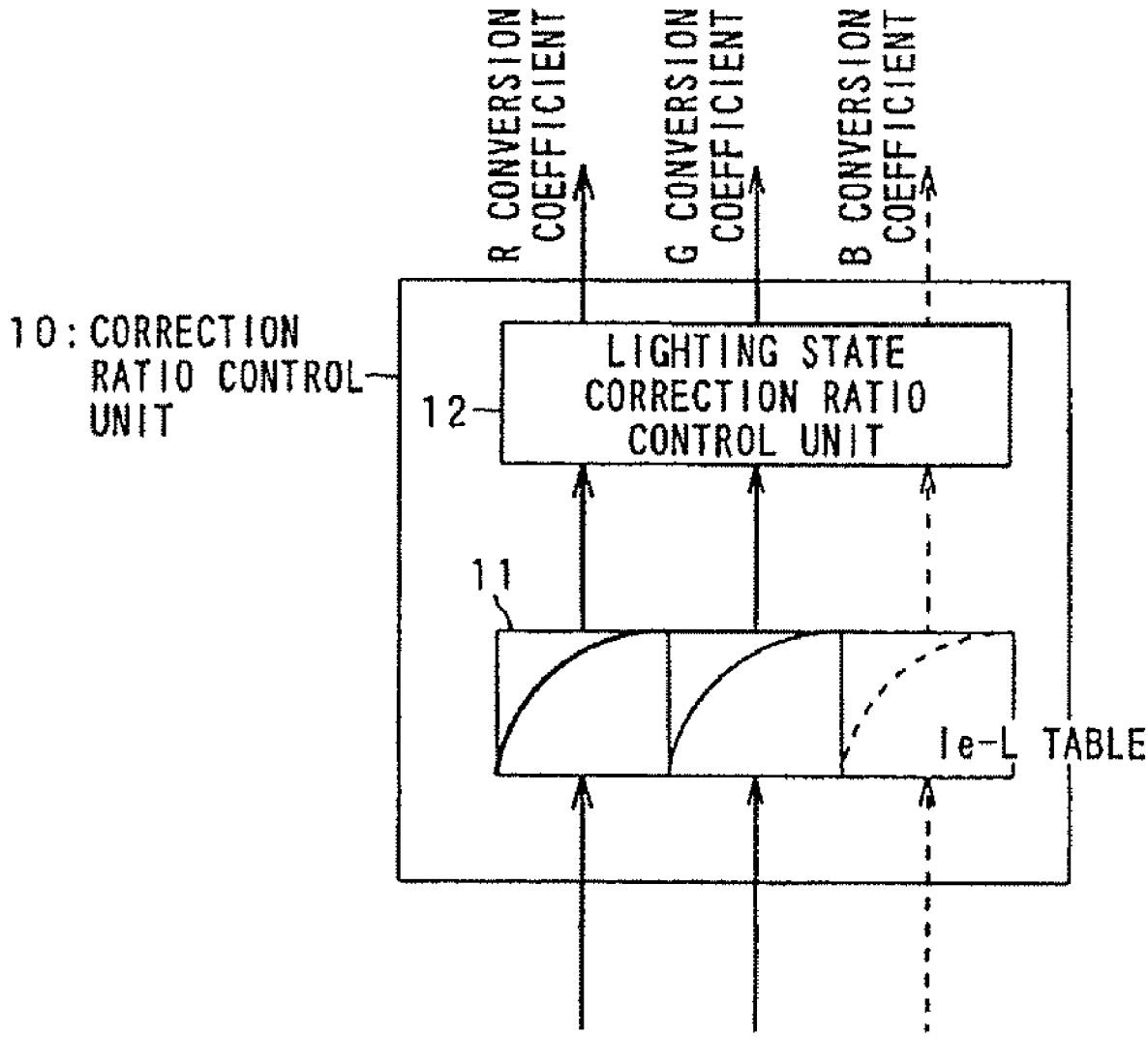
FIG. 3 is an inner configuration diagram of a correction ratio control unit 10 of FIG. 2.

Further, setting the phosphor saturation correction unit 17 on the front stage of the halation correction unit 15, the signal of the original image on the correction target phosphor place is made into a signal (an electric charge signal) (FIG. 2). Since the halation luminance is proportional to the beam electric charge amount when the halation amount is accessed, the processing of the selective addition unit 2 is carried out as it is. When adding the correction value to the electric charge signal, since the phosphor saturation correction has been completed in the electric charge signal of the beam, the correction value should be given the phosphor saturation correction processing when this correction value is added to the electric charge signal. Therefore, as shown in FIG. 3, the Ie-L table unit 11 is installed on the correction ratio control unit 10.

The gamma properties of R, G, and B are measured, and the Ie-L table unit 11 uses the gamma property that input and output are normalized at its highest value thereof (FIG. 6).

First Embodiment

The image display apparatus according to the present invention includes an SED display apparatus and an FED display apparatus or the like. These display apparatuses are preferable embodiments to which the present invention is applied because there are possibilities such that the halation light emission is generated on the peripheral reference pixel by the luminance of the luminance point that emits a light by itself.

The operation from the image signal is inputted in this SED panel till this image signal is displayed will be described below. In FIG. 4, a signal S1 is an input image signal which is subjected to the signal processing preferable for display in a signal processing unit 13 and a signal S2 is outputted as a display signal. With respect to the function of the signal processing unit 13, FIG. 4 shows the functional block of the minimum essential upon explanation of the present embodiment. A reference numeral 14 denotes an inversed $\gamma$ correction unit (corresponds to "the first correction circuit" of the present invention). Generally, assuming that the input image signal S1 is displayed by the CRT display apparatus, a no-linear conversion such as 0.45 power referred to as a gamma conversion in accordance with the input—light emission property of the CRT display is applied and then, the input image signal S1 is transmitted via a communication line or is recorded in a recording medium.

In order to display its image signal on a display device such as an SED, an FED, and a PDP having a linear input—light emission property, the inversed $\gamma$ correction unit 14 provides the inversed gamma conversion such as 2.2 power to the input signal. The output data of the inversed $\gamma$ correction unit 14 is converted into a format such that the luminance and the data of the display panel are linear and inputted to the halation correction unit 15, which is a characteristic part of the present embodiment. Practically, a true linear signal may not be obtained when the signal is processed by the circuit. Therefore, the inversed $\gamma$ correction unit 14 obtains the luminance signal by correcting the inputted image data so as to be brought close to a signal that is linear with respect to the luminance. The halation correction unit 15 will be described in detail later. In a BIT correction unit 16, output from the halation correction unit 15 is inputted, and in order to eliminate variation of light emission caused by the electron source and the phosphor, the BIT correction unit 16 eliminates variation of the adjacent light emissions by uniforming the highest luminance to a predetermined luminance value. The phosphor saturation correction unit 17 inputs the output of the BIT correction unit 16 therein, and considering the gamma property for each of the R, G, and B phosphors, adjusts input so as to be capable of faithfully displaying an output color and contrasting. The phosphor saturation correction unit 17 outputs the display signal S2 of the image that is optimum for the SED. A timing control unit 18 generates various timing signals for the operation of each block and output them on the basis of a synchronous signal that is given together with the input image signal S1.

A reference numeral 19 denotes a PWM pulse control unit and it converts the display signal S2 into a drive signal that is adapted for a display panel 25 (according to the example, a PWM modulation) for each horizontal period (a row selection period). A reference numeral 20 denotes a drive voltage control unit and it controls a voltage to drive a device that is arranged on the display panel 25. A reference numeral 21 denotes a column wiring switch unit that is formed by switch means such as a transistor and it applies the drive output from a drive voltage control unit 20 to a panel column electrode in every horizontal period (a row selection period) only for a PWM pulse period that is outputted from a PWM pulse control unit 19. A reference numeral 22 denotes a row selection control unit and it generates a row selection pulse for driving the device on the display panel 25. A reference numeral 23 denotes a row wiring switch unit that is formed by switch means such as a transistor and it outputs a drive output of the drive voltage control unit 20 to the display panel 25 in accordance with the row selection pulse outputted from the row selection control unit 22. A reference numeral 24 is a high voltage generation unit and it generates an acceleration voltage for accelerating an electron emitted from the electron-emitting device that is arranged on the display panel 25 in order to collide with the phosphor (not illustrated). Thus, the display panel 25 is driven and the image is displayed.

The drive circuit according to the present invention includes the signal processing unit 13, the PWM pulse control unit 19, the drive voltage control unit 20, the column wiring switch unit 21, the row selection control unit 22, and the row wiring switch unit 23.

<Halation Correction Unit 15>

Next, the halation correction unit 15, which is the characteristic part of the present invention, will be described with reference to FIG. 1.

Figure 17A:
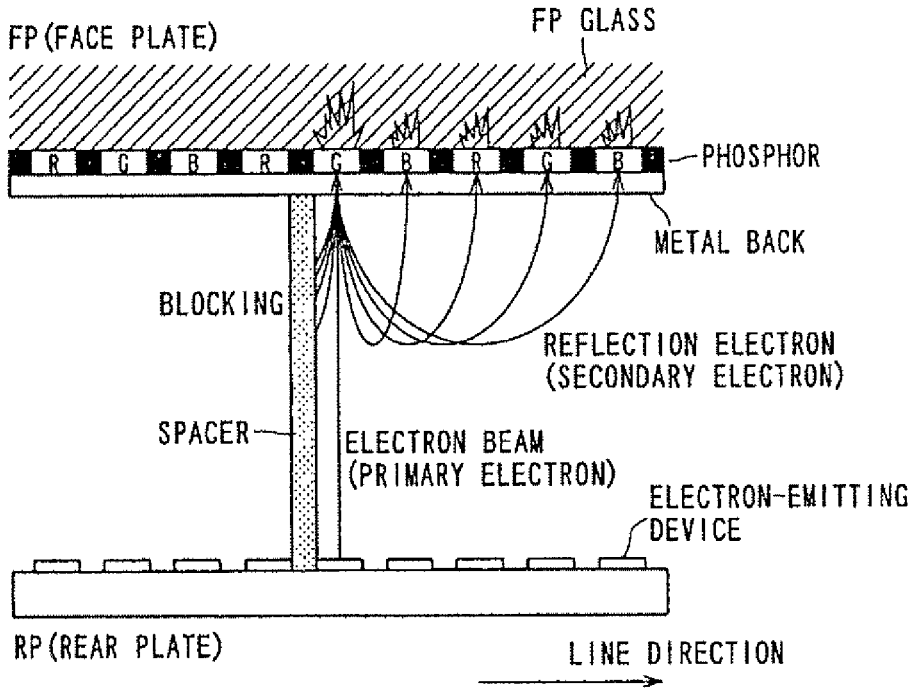
FIGS. 17A and 17B are views for explaining a halation generation mechanism in the vicinity of a spacer.

FIG. 17A shows an image display apparatus using an electron-emitting device formed on a rear plate and light emitting member (according to the present embodiment, phosphors having respective colors, namely, red, blue, and green) to be arranged on a face plate at intervals from the electron-emitting device. The present inventors has found out that a particular problem such that color reproducibility was different from a desired state is generated in the image display apparatus for making the light emitting member emit light by irradiating an electron beam (a primary electron) emitted from an electron-emitting device.

Figure 17B:
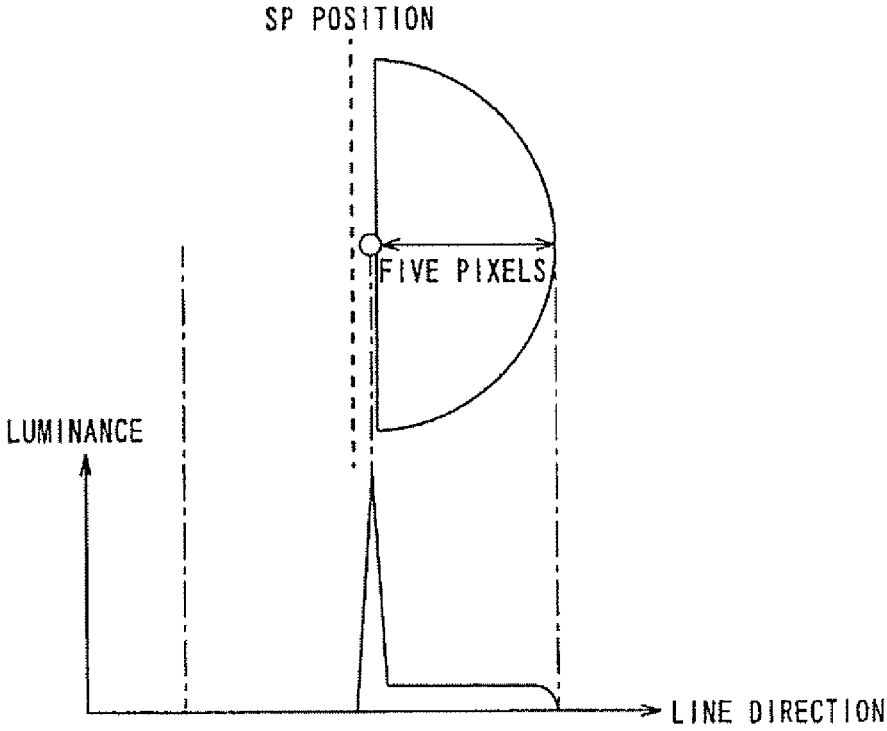
Figure 18:
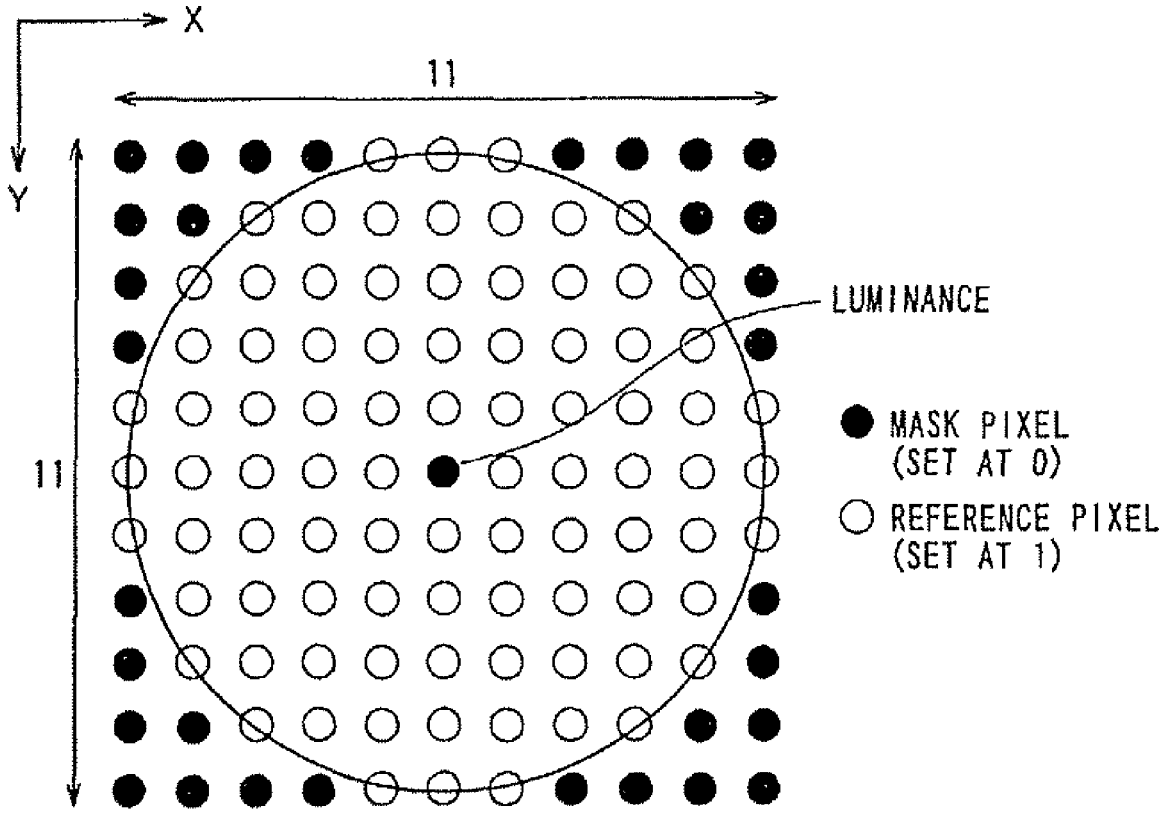
FIG. 18 is a view showing a halation mask pattern of 11×11.

As a specific example, it has been found out that when it is intended to obtain blue light emission by irradiating electron to only the blue phosphor, a light emission state does not become a pure blue but mixed with other colors slightly (namely, green and red), namely, a light emission state having a poor chroma saturation is generated. As a result of further studies, the present inventors confirmed a cause to lower chroma saturation. A primary electron emitted by an electron-emitting device enters a light emitting member corresponding to this electron-emitting device, and this makes the corresponding light emitting member emit light at a bright point. In addition to this, the present inventors confirmed that a peripheral light emitting members also emitted light when the electron was reflected by the light emitting member and entered in a neighboring (including adjacent) light emitting region having a different color as a backward scattered electron (a reflection electron, a secondary electron). The phenomenon that a display device emits light due to an influence of driving of the neighboring display device, such as light emission caused by backward scattered electron as above, is referred to as a halation according to the present invention. In the SED, it was found that, when a phosphor was irradiated with electron, a circle light emission, as shown in FIG. 17B, (representing it by a luminance as a light emission amount, it is distributed in a columnar shape around a bright point) by the halation around this display device occurred. If a radius of this circular region influence by this halation has n pixels, a filter of 2n+1 taps as a pixel reference range for the halation correction processing to be described in detail later is needed. Further, it was found that there was no harm from a practical stand point if the radius of the region that the halation covers was uniquely decided depending on an interval between the face plate on which the phosphor was arranged and the rear plate on which the electron source was arranged and a pixel size or the like. Accordingly, if the interval between the face plate and the rear plate has been known, the number of the filter taps can be uniquely decided. According to the present embodiment, since the number of pixels is n=5, it is known that the data reference of 11 tap filters, namely, the data reference of 11 pixels×11 lines may be carried out as shown in FIG. 18 in order to consider the influence degree of the halation. Thus, the radius of the region that the halation covers is a static parameter that can be obtained from a physical configuration of a panel (the interval between the face plate and the rear plate, the pixel size). Therefore, in the case of relating the same correction circuit to a plurality of SED panels of different kinds, a halation mask pattern of FIG. 18 may be changed as a variable parameter.

Figure 19A:
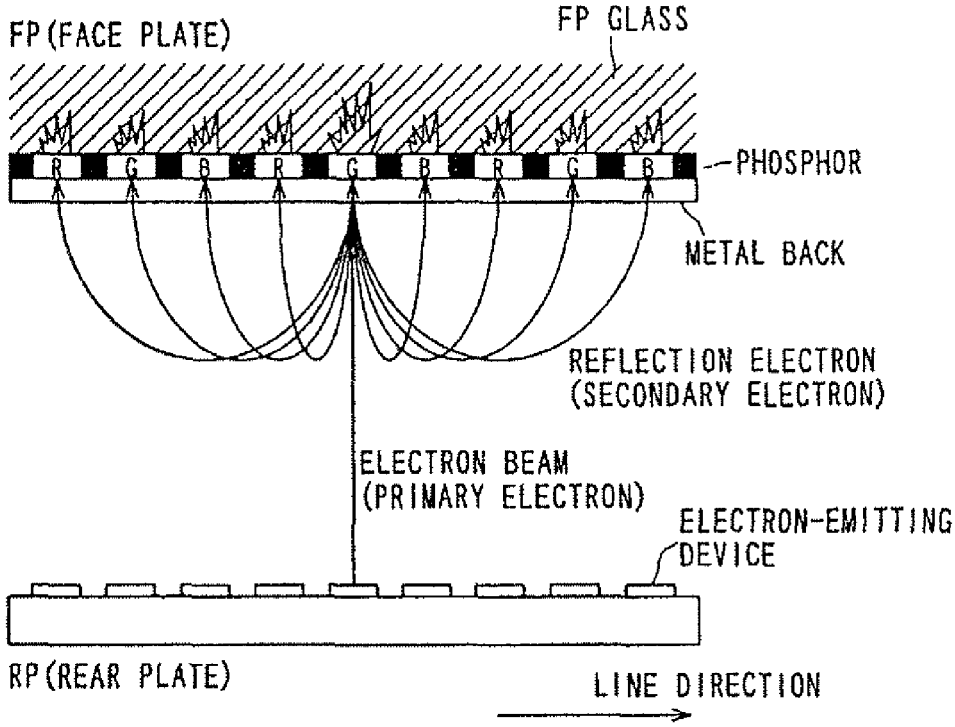
FIGS. 19A and 19B are views for explaining a halation generation mechanism not in the vicinity of a spacer.
Figure 19B:
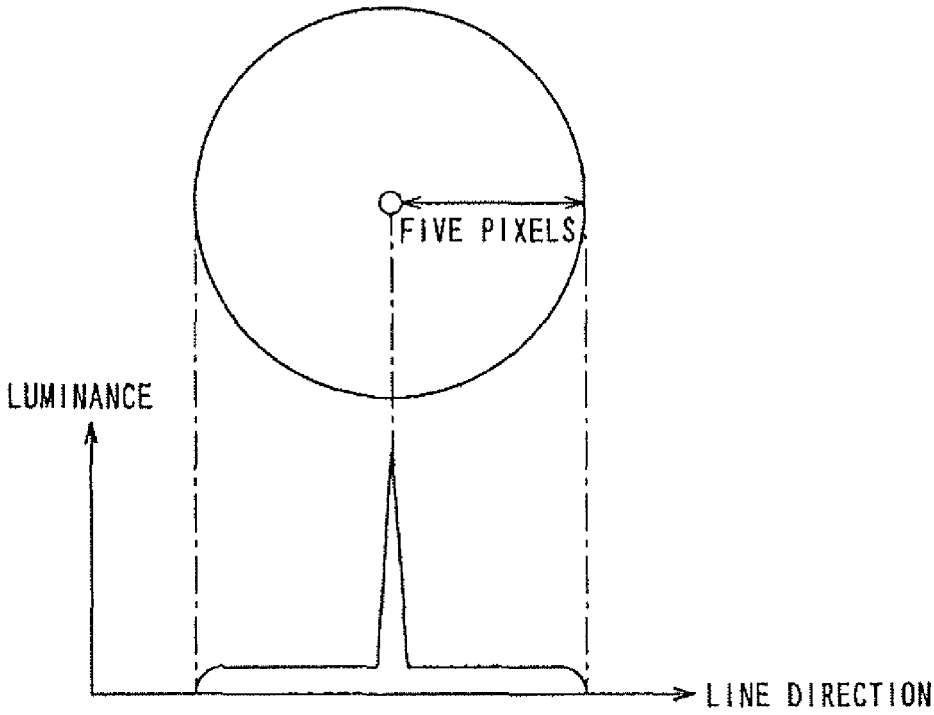

FIG. 19 shows the case that there is no blocking member like a spacer on a reflection or bit of the reflection electron (not in the vicinity of the spacer) When there is the blocking member like the spacer (in the vicinity of the spacer), the backward scattered electron (the reflection electron, a secondary electron) is blocked by the spacer as shown in FIG. 17A, so that the halation intensity is reduced. Therefore, when the electron beams (the primary electron) are emitted from the electron-emitting device nearest to the spacer, it was found that halation has influence on a semicircular light-emitting range as shown in FIG. 17B. In FIG. 19A and FIG. 17A, it is illustrated that the phosphors are arranged in a line direction in alternate shifts of R, G, and B, namely, a lateral stripe for the purpose of making the explanation simple, however, they are arranged in alternate shifts of R, G, and B, namely, a longitudinal stripe in fact.

Figure 20A:
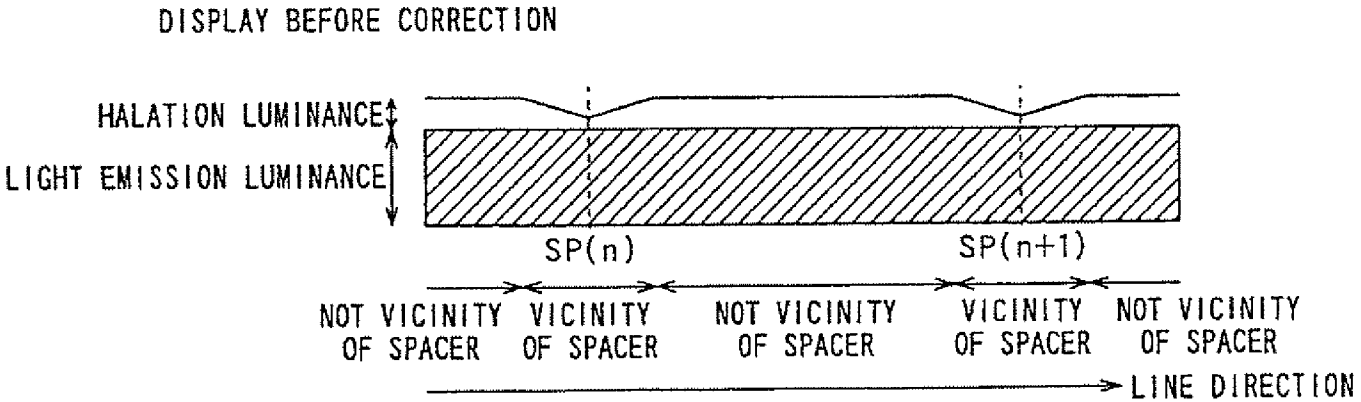
FIGS. 20A and 20B are views showing an image of a halation correction according to a blocking amount addition system.

The above-described operation is a generation mechanism of the halation that is described with reference to an example of one-device driving. On the SED used in the present embodiment, a plurality of long spacers extending in a horizontal direction is mounted for every several tens of lines. In the case of lighting at the same color on the entire screen, due to the above-described halation, it is confirmed that there is a difference in the halation amount between the different regions, namely, the region in the vicinity of the spacer and the region not in the vicinity of the spacer and a particular problem of the spacer unevenness that a color purity is varied in the vicinity of the spacer is generated. The difference of the spacer unevenness is varied depending on the lighting pattern. When a blue light is flashed on the entire screen, for example, as shown in FIG. 20A, the halation luminance is added to the blue light emission luminance and in the vincity of the spacer the amount of blocking of the reflection electron is changed step-by-step according to the distance from the spacer, so that wedge wise and step-by-step change of a color purity of a width about 10 lines can be confirmed visually.

As a result of an earnest study, in consideration of a cause to make the above-described spacer unevenness, the present inventors found a novel configuration of an image display apparatus that can improve an image quality of the SED and a correction method of a drive signal. Hereinafter, a specific example of the image display apparatus and the drive signal according to the present application will be described with reference to FIG. 1.

A reference numeral 1 denotes a line memory and according to the present embodiment, it is configured by 11 line memories. The original image data are written in the line memory 1 in series by the line. Then, when the data for 11 lines are stored, the data of 11 pixels×11 lines are read at the same time for reference of calculation.

Figure 21:
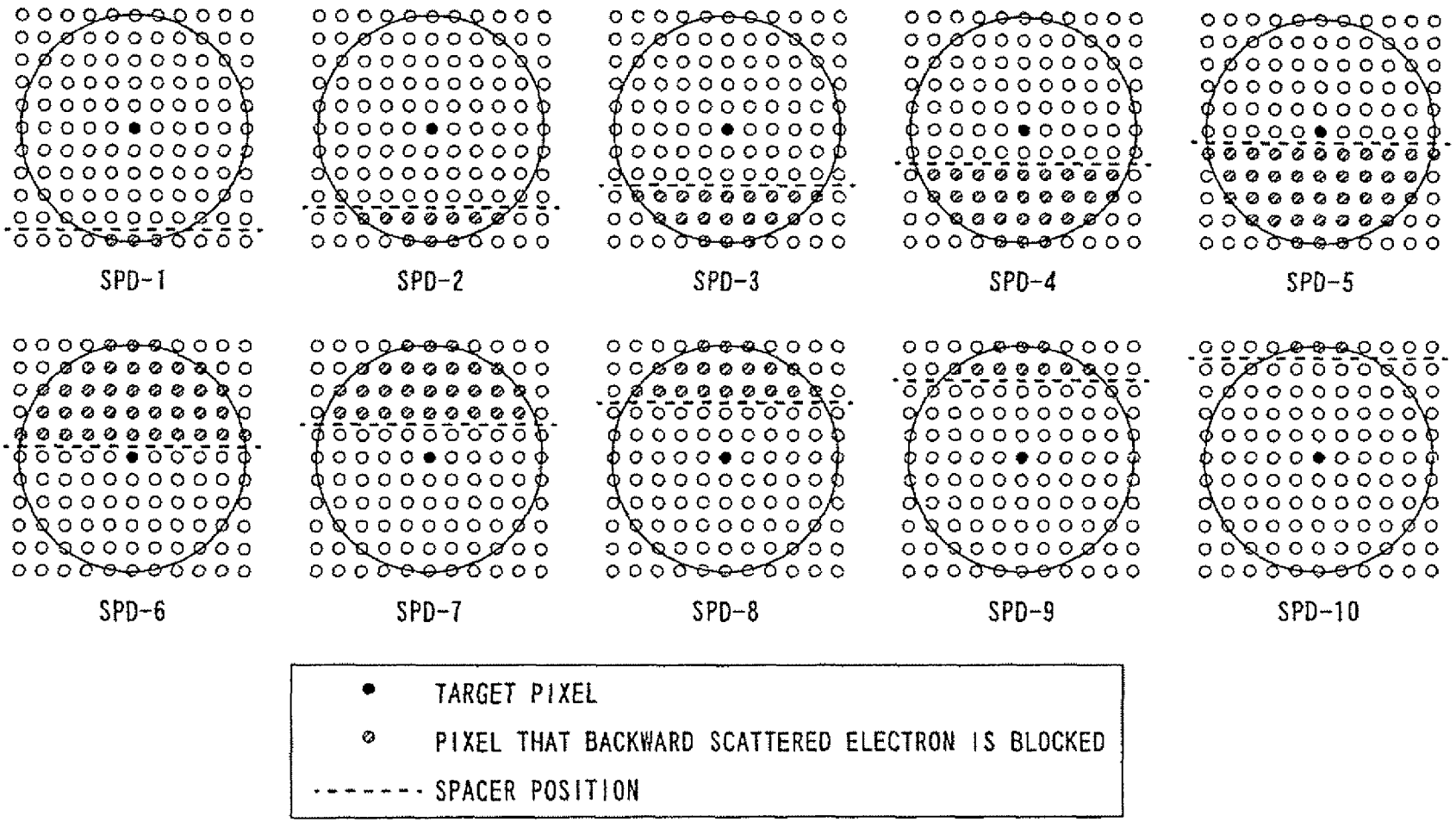
FIG. 21 is a corresponding view of a pixel region where a reflection electron is blocked in accordance with a distance between a correction target pixel and a spacer.

The data of 11 pixels×11 lines around the correction target pixels that are read at the same time are converted into a format that can calculate the halation amount and they are referred for calculation by the selective addition unit 2. Then, the data of the correction target pixel is given to the correction value addition unit 7. The conversion processing into the format that can calculate the halation amount in this case is carried out by the L-Ie table unit 9. Since this processing is changed depending on the processing content in a signal processing unit, the detail will be described later. The selective addition unit 2, for each correction target pixel in the vincity of the spacer, selectively adds only reflection electrons that are blocked by the spacer among the reflection electrons from the peripheral pixels. Whether the correction target pixels are located in the vicinity of the spacer or not is determined depending on an SPD (Spacer Distance) value. Here, an SPD value is generated by the spacer positional information generation unit 4 according to a timing control signal received from the timing control unit 18 and a spacer positional information, and it represents a positional relation between a correction target pixel and the spacer. As shown in FIG. 21, there are ten patterns of the pixels corresponding to the reflection electrons that are blocked in the correction target pixels in the vicinity of the spacer and a total lighting amount related to the blocking amount can be obtained by selecting the value of the pixel represented in gray in accordance with the SPD value and adding all of them. Further, one pixel is formed by three display devices and has a light emitting region of red (R), green (G), and blue (B). The input signal is configured so as to be inputted as an R signal, a G signal, and a B signal corresponding to one pixel. Then, multiplying the data related to the blocking amount for each color and figuring out a sum of the multiplication results for each color of RGB, this sum is outputted from the selective addition unit 2. Since blocking of the electrons by the spacer is not caused not in the vicinity of the spacer, the additional result may be 0. The coefficient multiplication unit 3 multiplies the additional result with a coefficient showing what percentage of the additional result is defined as the amount of the blocked halation (namely, a halation gain value). The coefficient is normally within a range of 0 to 1 and in the real panel, it takes a value about 1.5% (0.015). The data to be outputted from the coefficient multiplication unit 3 takes a value evaluating a mixed light emission suppression effect by the spacer. As described above, this value is made into a value collectively evaluating the image data corresponding to respective colors (namely, an evaluation value).

Figure 20B:
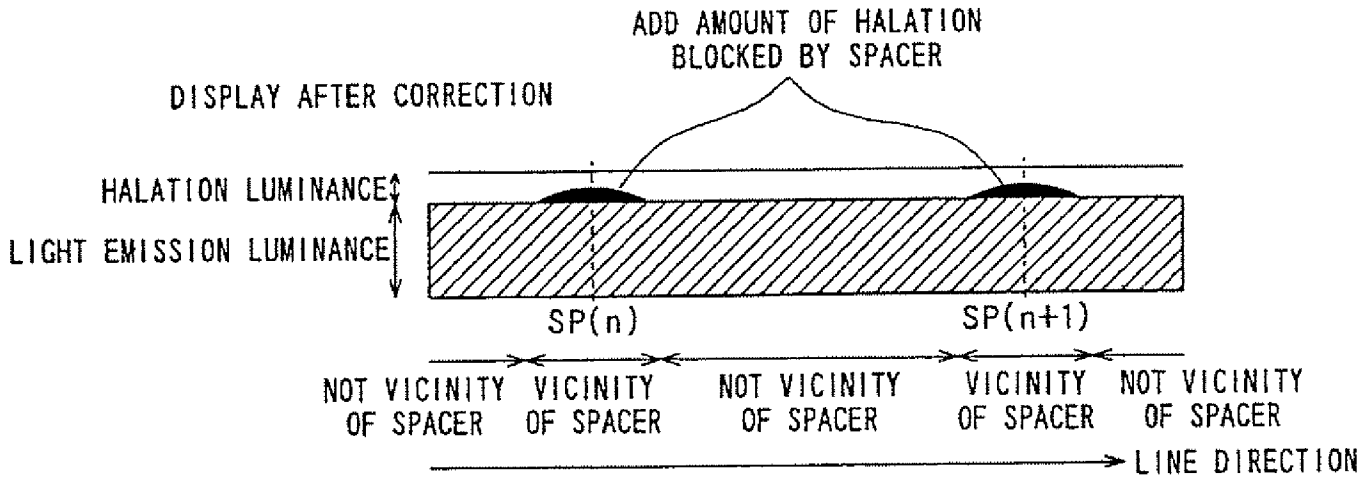

The correction data before adjustment that is calculated by the coefficient multiplication unit 3 is multiplied with a conversion coefficient (the adjustment value) for respective R, G, and B phosphors by the adjustment gain multiplication unit 5. The conversion coefficient in this case is also changed by the processing content in the signal processing unit, so that the details are described later. Adding the result of multiplying the conversion coefficient to the original image data by the correction value addition unit 7 and outputting its result as a correction image, before correction shown in FIG. 20A, step-by-step change of a color purity in the vicinity of the spacer is added with the correction value equivalent to the halation for the reflection electrons that are blocked by the spacer in the image data in the vicinity of the spacer as shown in FIG. 20B and a difference of a color purity between the part not in the vicinity of the spacer and the part in the vicinity of the spacer is reduced as the entire screen and the spacer unevenness due to the halation can be also corrected.

The Ie-L table unit 11, the L-Ie table unit 9, the lighting state correction ratio control units 8 and 12, and the correction ratio control unit 10 that are changed in accordance with change of the inside of the signal processing will be described in detail below.

As shown in FIG. 4, if the halation correction unit 15 is located before the phosphor saturation correction unit 17, in FIG. 1, the L-Ie table unit 9 and the lighting state correction ratio control units 8 are provided.

Figure 10:
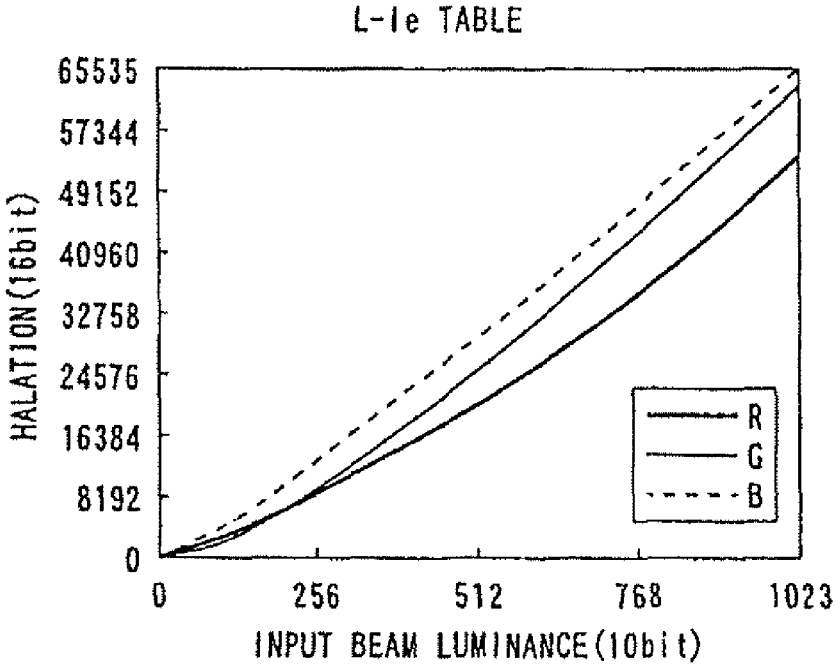
FIG. 10 is a view showing an L-Ie table unit data (an input 10 bit-an output 16 bit) when a Bit correction is considered.

In the circuit that is configured as described above, the gamma properties of respective R, G, and B phosphors and the halation light emission efficiency according to the beam lighting state are measured, and the L-Ie table unit shown in FIG. 10 is provided as the L-Ie table unit 9 and the lighting state correction ratio control table shown in FIG. 11 is provided as the lighting state correction ratio control units 8.

Writing a table having a degree of accuracy of an input 10 bit and an output 16 bit (FIG. 10) in an RAM, the L-Ie table is used. By appropriately improving the degree of accuracy and saving a capacity of the RAM and the processing time or the like so as to make the size of a calculation device smaller, it may be possible to realize the system of a low cost.

Figure 12:
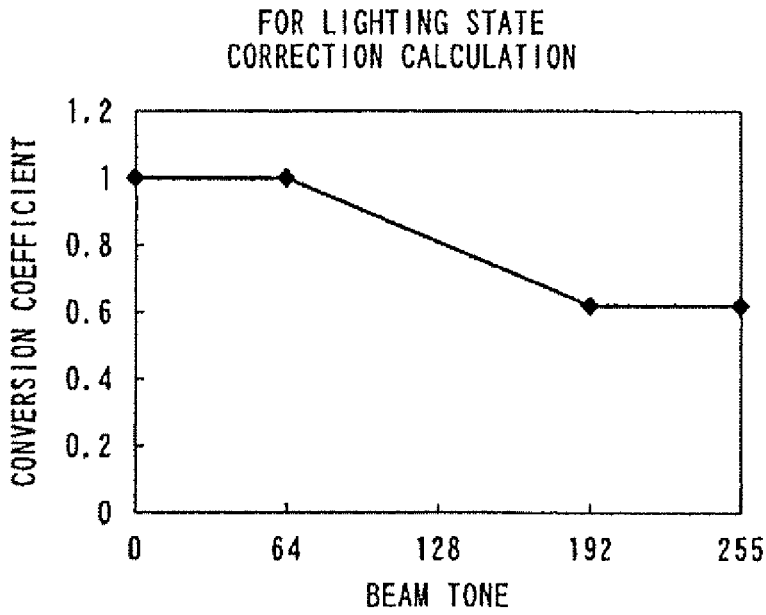
FIG. 12 is a view showing a conversion coefficient (for calculation processing) (an input 8 bit) to be inputted in a lighting state correction ratio control unit.
Figure 13:
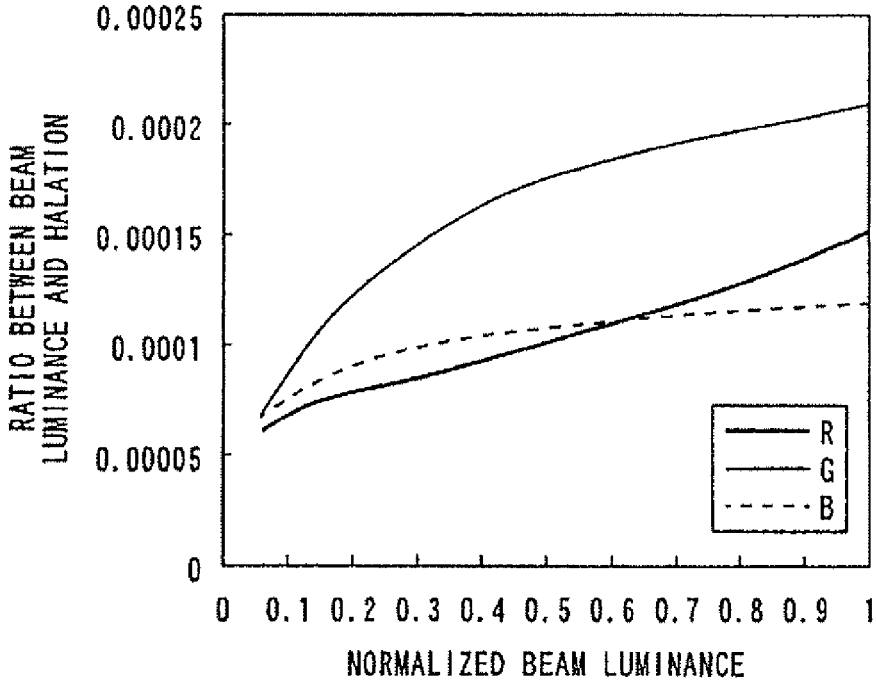
FIG. 13 is a variation view showing change of beam luminance—halation ratio according to input tone, which is obtained by measuring a phosphor.
Figure 14:
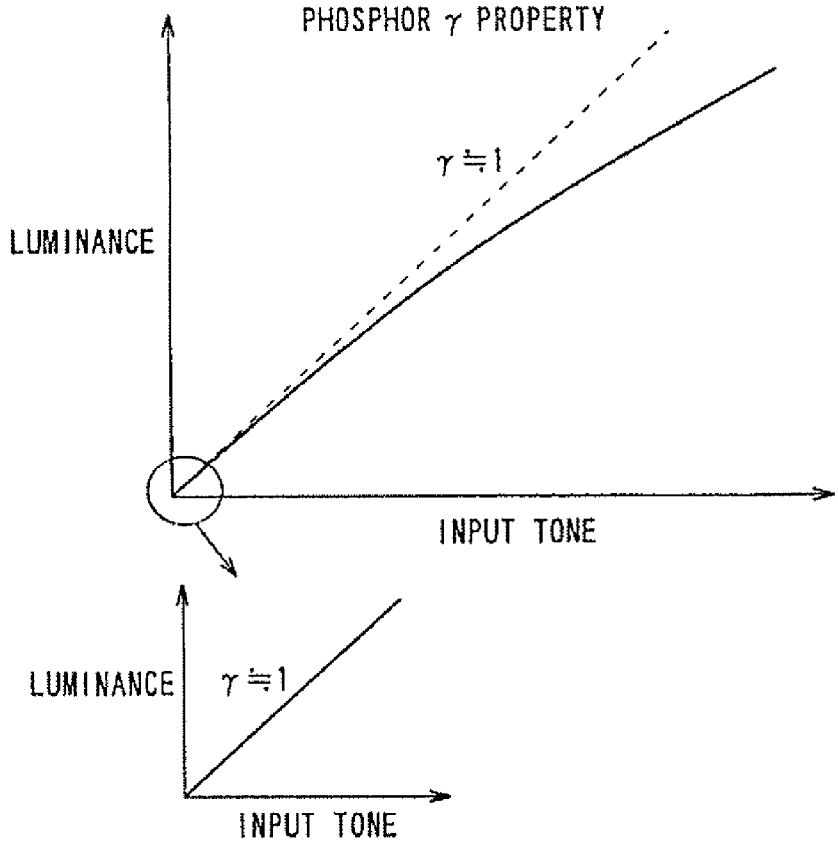
FIG. 14 is a view for explaining a phosphor gamma property.
Figure 15:
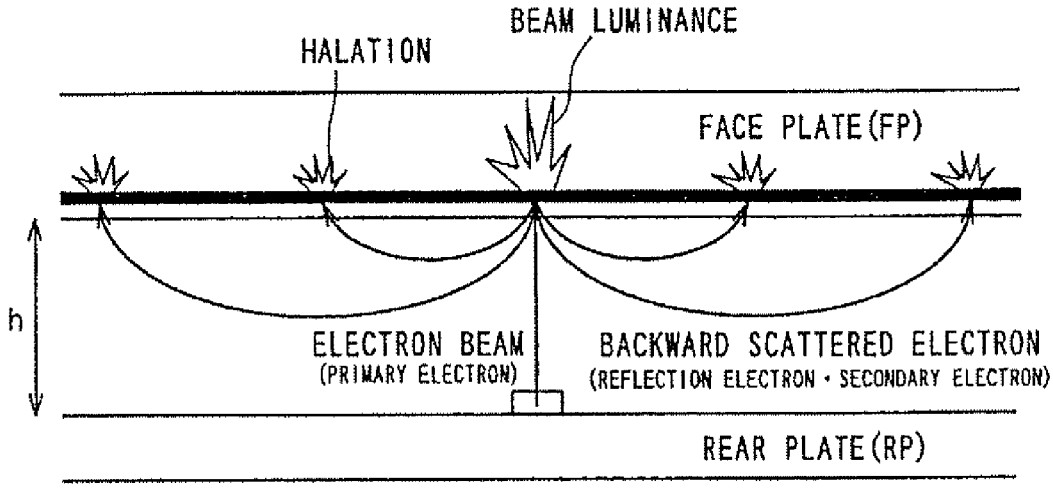
FIG. 15 is a view for explaining a generation principle of a beam luminance and a halation.

As the lighting state correction ratio control unit 8, a lighting state correction ratio control table obtained by measurement of FIG. 11 is used. In order to save a memory and a processing time or the like, as shown in FIG. 12, giving a parameter having several plots set therein, the lighting state correction can be also substituted by the calculation processing. The lighting state correction ratio control table includes a portion in which, the larger the luminance to be indicated by the luminance signal is, the smaller the conversion coefficient is.

Like this, by setting the L-Ie table as the L-Ie table unit 9 and setting the Ie-L table unit 11 as the lighting state correction ratio control unit 8, the lighting state can be corrected at a high degree of accuracy under various lighting states.

Since the above-described correction table and the conversion coefficient table are written in the RAM, these correction table and conversion coefficient table can be changed in accordance with a property of a phosphor of a display panel. Then, since they can be changed, it is possible to reduce the display unevenness for each display panel.

According to the present embodiment, the inversed γ correction unit 14 is equivalent to the first conversion circuit of the present invention. The L-Ie table unit 9 is equivalent to the second conversion circuit of the present invention. The selective addition unit 2 and the coefficient multiplication unit 3 are equivalent to the correction value calculation circuit of the present invention and the evaluation value to be outputted from the coefficient multiplication unit 3 is equivalent to the correction value to be calculated by the correction value calculation circuit of the present invention. The adjustment gain multiplication unit 5 and the lighting state correction ratio control unit 8 are equivalent to the correction value adjustment circuit of the present invention. The correction value addition unit 7 is equivalent to the correction value addition circuit of the present invention.

In addition, the inversed γ correction unit 14 is equivalent to the first correction circuit of the present invention. The halation correction unit 15 is equivalent to the second correction circuit of the present invention. The line memory 1, the L-Ie table unit 9, the selective addition unit 2, and the coefficient multiplication unit 3 are equivalent to the evaluation value calculation circuit of the present invention. The adjustment gain multiplication unit 5 and the lighting state correction ratio control unit 8 are equivalent to the correction value adjustment circuit of the present invention.

Second Embodiment

As shown in FIG. 5, when the halation correction unit 15 is located on the rear stage of the phosphor saturation correction unit 17 (equivalent to "the first correction circuit" according to the present invention), the correction ratio control unit 10 is installed as shown in FIG. 2.

The operation of the lighting state correction ratio control unit 12 of the correction ratio control unit 10 shown in FIG. 3 is the same as that of the first embodiment.

In the constituent circuit as described above, the halation light emission efficiency due to the gamma property of respective phosphors of R, G, and B and the beam lighting state are measured, and the optimum table (FIG. 6) is instated as the Ie-L table unit 11 and the optimum parameter (FIG. 11) is installed as the lighting state correction ratio control unit 12.

Figure 7:
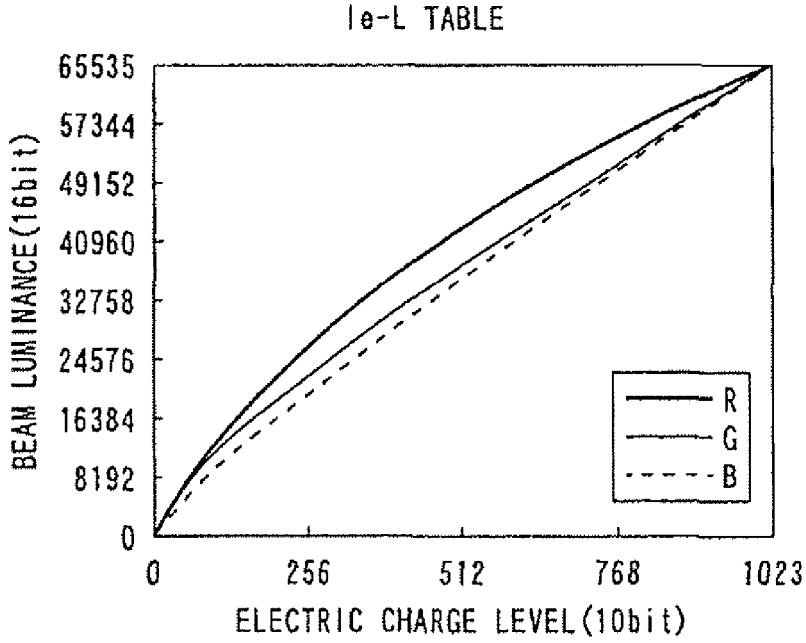
FIG. 7 is a view showing an Ie-L table unit data (an input 10 bit and an output 16 bit)

Further, as the Ie-L table unit 11, a table having the degree of accuracy of the input 10 bit and the output 16 bit (FIG. 7) is used.

By setting this parameter as the Ie-L table unit 11 shown in FIG. 3 and setting this parameter as the lighting state correction ratio control unit 12, even under various lighting states, the correction can be made at a high degree of accuracy.

According to the present embodiment, the phosphor saturation correction unit 17 is equivalent to the first correction circuit of the present invention. The halation correction unit 15 is equivalent to the second correction circuit of the present invention. The line memory 1, the selective addition unit 2, and the coefficient multiplication unit 3 are equivalent to the evaluation value calculation circuit 6 of the present invention. The adjustment gain multiplication unit 5, the lighting state correction ratio control unit 12, and the Ie-L table unit 11 are equivalent to the adjustment circuit of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-347332, filed on Dec. 25, 2006 which is hereby incorporated by reference herein in its entirety.

What is claimed is:

1. An image display apparatus comprising:

a plurality of pixels having an electron-emitting device and a light emitting region that emits light when an electron emitted from the electron-emitting device enters therein, respectively;

a spacer for maintaining a space between the electron-emitting device and the light emitting region;

a first conversion circuit for converting an image signal;

a second conversion circuit for converting output of the first conversion circuit;

a correction value calculation circuit for calculating a correction value on the basis of output of the second conversion circuit;

a correction value adjustment circuit for adjusting the correction value on the basis of output of the first conversion circuit and outputting the adjusted correction value; and a correction value addition circuit for correcting output of the first conversion circuit by the adjusted correction value;

wherein the first conversion circuit performs conversion such that a linearity between output of the first conversion circuit and a luminance to be displayed becomes higher than a linearity between the image signal and the luminance to be displayed;

the second conversion circuit is a circuit such that a linearity between output of the second conversion circuit and the amount of electron to be emitted is higher than a linearity between output of the first conversion circuit and the amount of electron to be emitted;

the spacer is located on a position where an electron directed from a light emitting region of a first pixel toward a light emitting region of a second pixel is blocked;

the correction value calculation circuit calculates a correction value corresponding to the second pixel on the basis of the output corresponding to the first pixel in the output of the second conversion circuit; and the correction value is a value that can reduce a difference between a luminance of the second pixel and a luminance of a pixel that is located separately from the spacer further than the second pixel.

2. An image display apparatus comprising:

a plurality of pixels having an electron-emitting device and a light emitting region that emits light when an electron emitted from the electron-emitting device enters therein, respectively;

a first conversion circuit for converting an image signal;

a second conversion circuit for converting output of the first conversion circuit;

a correction value calculation circuit for calculating a correction value on the basis of output of the second conversion circuit;

a correction value adjustment circuit for adjusting the correction value on the basis of output of the first conversion circuit and outputting the adjusted correction value; and a correction value addition circuit for correcting output of the first conversion circuit by the adjusted correction value;

wherein the first conversion circuit performs correction such that a linearity between output of the first conversion circuit and a luminance to be displayed becomes higher than a linearity between the image signal and the luminance to be displayed;

the second conversion circuit performs correction such that a linearity between output of the second conversion circuit and the amount of electron to be emitted becomes higher than a linearity between output of the first conversion circuit and the amount of electron to be emitted;

the plurality of pixels includes a first pixel and a second pixel located in the vicinity of the first pixel, and a distance between the first pixel and the second pixel is one that a reflection electron from the first pixel reaches the second pixel;

the correction value calculation circuit calculates a correction value corresponding to the second pixel on the basis of the output corresponding to the first pixel in the output of the second conversion circuit; and the correction value is a value that can correct increase of the luminance of the second pixel due to the light emission of the second pixel generated by the reflection electron from the first pixel.

3. An image display apparatus comprising:

a plurality of display devices having corresponding light emitting regions, respectively, and displaying an image by making the light emitting regions emit light;

a spacer for preventing the light emission of the predetermined light emitting region caused by driving of a display device corresponding to the light emitting region other than a predetermined light emitting region; and a drive circuit for outputting a drive signal to drive the display device on the basis of the inputted image data;

wherein the drive circuit has a first correction circuit for obtaining a luminance signal by correcting the inputted image data so as to be brought close to a signal that is linear with respect to the luminance, and a second correction circuit for outputting the corrected drive signal;

the second correction circuit has an evaluation value calculation circuit for calculating an evaluation value that evaluates a suppression effect that the spacer suppresses an influence on the light emission of a predetermined light emitting region due to the inputted image data, the influence being caused by driving of the display device corresponding to the light emitting region other than the predetermined light emitting region, and an adjustment circuit;

the evaluation value calculation circuit converts the luminance signal into an electric charge signal showing an electric charge amount that is necessary for obtaining a luminance that is designated by a luminance signal by correcting the luminance signal so as to be brought close to a signal that is linear with respect to the electric charge amount and then, calculates the evaluation value that evaluates the suppression effect by using the electric charge signal; and the adjustment circuit calculates an adjustment value that refers to a property of a phosphor of the display device on the basis of the luminance signal and dynamically calculates a correction value corresponding to the drive signal using the evaluation value and the adjustment value.

4. An image display apparatus according to claim 3, wherein the second correction circuit has a correction value addition circuit for adding the correction value to the luminance signal that is a correction target.

5. An image display apparatus according to claim 3, wherein the adjustment circuit outputs a value that is obtained by adjusting the evaluation value by the adjustment value as a correction value.

6. An image display apparatus according to claim 3, wherein, the larger the luminance that is indicated by the luminance signal, the adjustment circuit carries out calculation so that the adjustment value is made smaller.

7. An image display apparatus according to claim 3, wherein the display device has an electron-emitting device and a predetermined light emitting region that is arranged at a space from the electron-emitting device and emits light by irradiation with an electron to be emitted from the electron-emitting device;

the spacer is an electron blocking member for preventing an electron originated with an electron emitted from an electron-emitting device in the vicinity of the electron-emitting device corresponding to a predetermined light emitting region from being irradiated on the predetermined light emitting region by blocking the electron emitted from an electron-emitting device in the vicinity of the electron-emitting device corresponding to the predetermined light emitting region; and the evaluation value in the evaluation value calculation circuit is a value that is obtained by evaluating the blocking amount that the spacer blocks the electron emitted from the electron-emitting device in the vicinity of the electron-emitting device corresponding to the predetermined light-emitting region from being irradiated to the predetermined light emitting region.

8. An image display apparatus comprising:

a plurality of display devices having corresponding light emitting regions, respectively, and displaying an image by making the light emitting region emit light;

a spacer for preventing the light emission of a predetermined light emitting region caused by driving of a display device corresponding to the light emitting region other than the predetermined light emitting region; and a drive circuit for outputting a drive signal to drive the display device on the basis of the inputted image data;

wherein the drive circuit has a first correction circuit for obtaining an electric charge signal by correcting the inputted image data so as to be brought close to a signal that is linear with respect to the electric charge amount; and a second correction circuit for outputting the corrected drive signal;

the second correction circuit has a calculation circuit for calculating an evaluation value that evaluates a suppression effect that the spacer suppresses an influence on the light emission of a predetermined light emitting region due to the inputted image data, the influence being caused by driving of the display device corresponding to the light emitting region other than the predetermined light emitting region, and an adjustment circuit;

the calculation circuit calculates the evaluation value that evaluates the suppression effect by using the electric charge signal; and the adjustment circuit converts the electric charge signal into a luminance signal by correcting the electric charge signal so as to be brought close to a signal that is linear with respect to the luminance, calculates an adjustment value that refers to a property of a phosphor of the display device on the basis of the luminance signal, and dynamically calculates a correction value corresponding to the drive signal using the evaluation value and the adjustment value.

9. An image display apparatus according to claim 8, wherein the second correction circuit has a correction value addition circuit for adding the correction value to the electric charge signal that is a correction target.

10. An image display apparatus according to claim 8, wherein the adjustment circuit outputs a value that is obtained by adjusting the evaluation value by the adjustment value as a correction value.

11. An image display apparatus according to claim 8, wherein, the larger the luminance that is indicated by the luminance signal is, the adjustment circuit carries out calculation so that the adjustment value is made smaller.

12. An image display apparatus according to claim 8, wherein the display device has an electron-emitting device and a light emitting region that is arranged at a space from the electron-emitting device and emits light by irradiation with an electron to be emitted from the electron-emitting device;

the spacer is an electron blocking member for preventing an electron originated with an electron emitted from an electron-emitting device in the vicinity of the electron-emitting device corresponding to a predetermined light emitting region from being irradiated on the predetermined light emitting region by blocking the electron emitted from an electron-emitting device in the vicinity of the electron-emitting device corresponding to the predetermined light emitting region; and the evaluation value in the evaluation value calculation circuit is a value that evaluates the blocking amount that the spacer blocks the electron emitted from the electron-emitting device in the vicinity of the electron-emitting device corresponding to the predetermined light-emitting region from being irradiated to the predetermined light emitting region.

* * * * *